US008814311B2

(12) United States Patent
Akiyama et al.

(10) Patent No.: US 8,814,311 B2
(45) Date of Patent: Aug. 26, 2014

(54) INKJET PRINTER AND CONTROL METHOD FOR INKJET PRINTER

(75) Inventors: Hiroaki Akiyama, Nagano (JP); Ryoichi Nozawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 179 days.

(21) Appl. No.: 13/425,545

(22) Filed: Mar. 21, 2012

(65) Prior Publication Data

US 2012/0249651 A1 Oct. 4, 2012

(30) Foreign Application Priority Data

Mar. 30, 2011 (JP) ..... 2011-075803

(51) Int. Cl.
*B41J 29/38* (2006.01)
*B41J 11/00* (2006.01)

(52) U.S. Cl.
CPC ..... *B41J 11/002* (2013.01); *B41J 29/38* (2013.01)
USPC ..... 347/16

(58) Field of Classification Search
CPC ..... B41J 11/002; B41J 29/38
USPC ..... 347/16
See application file for complete search history.

(56) References Cited

U.S. PATENT DOCUMENTS

2004/0119802 A1 6/2004 Yoneyama et al.
2011/0096132 A1* 4/2011 Kobayashi et al. ..... 347/102

FOREIGN PATENT DOCUMENTS

JP 2003-080687 A 3/2003
JP 2004-188966 A 7/2004
JP 3855724 B2 12/2006
JP 2007-160252 A 6/2007
JP 2009-154409 A 7/2009
JP 154409 A * 7/2009
JP 2009154409 A * 7/2009
JP 2010-234704 A 10/2010

* cited by examiner

*Primary Examiner* — Matthew Luu
*Assistant Examiner* — Tracey McMillion
(74) *Attorney, Agent, or Firm* — Global IP Counselors, LLP

(57) ABSTRACT

A inkjet printer includes an ejection head, a curing-light-emitting part, a head retaining part, a relative scanning part, a drive output detecting part, and a curing-light-emission-control part. The ejection head ejects a photocuring liquid onto a printing medium retained by a medium retaining part. The curing-light-emitting part emits curing light onto the printing medium. The head retaining part retains the ejection head and the curing light emitting part. The relative scanning part performs relative movement of the head retaining part and the medium retaining part. The drive output detecting part detects an output of a drive source of the relative scanning part. The curing-light-emission-control part controls the curing-light-emitting part based on a detection result from the drive output detecting part.

9 Claims, 10 Drawing Sheets

Fig. 8A
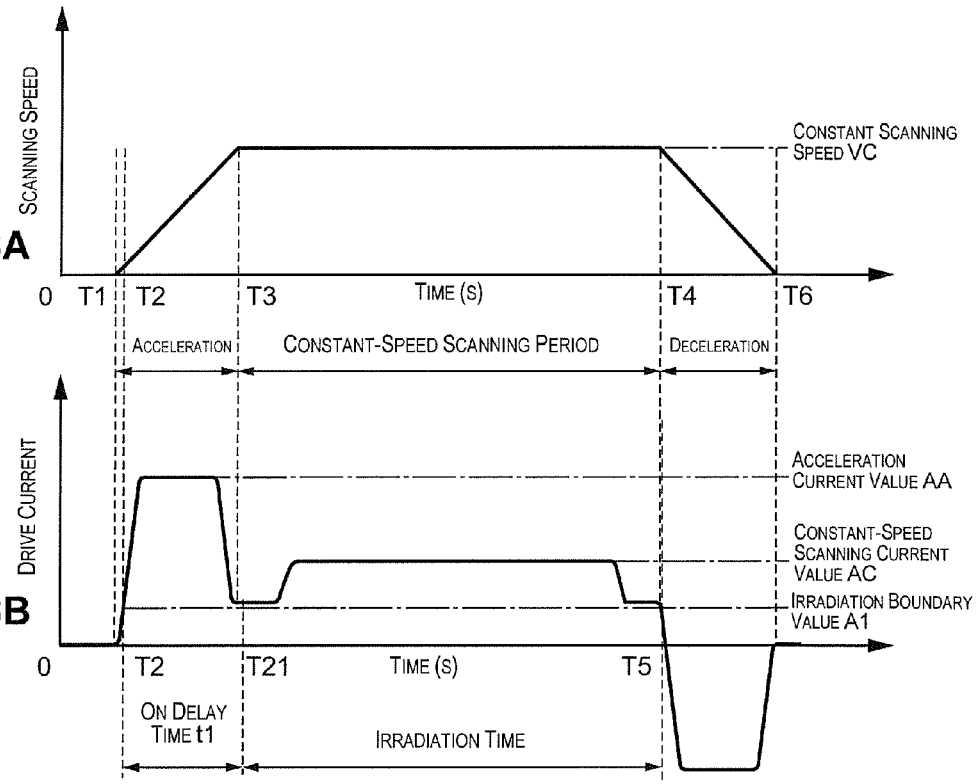
Fig. 8B
Fig. 8C
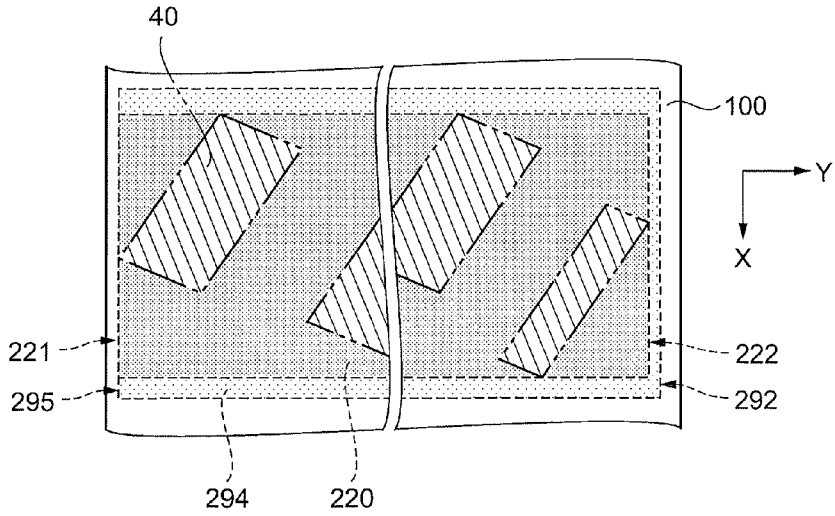

Fig. 9A
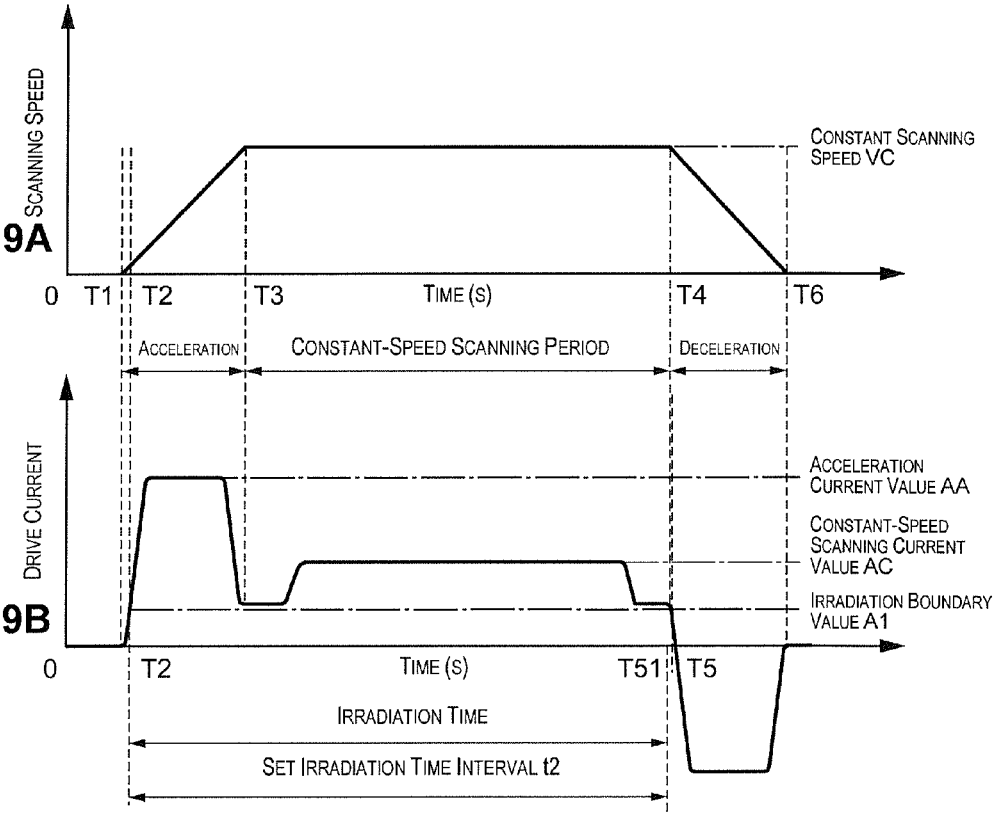
Fig. 9B
Fig. 9C
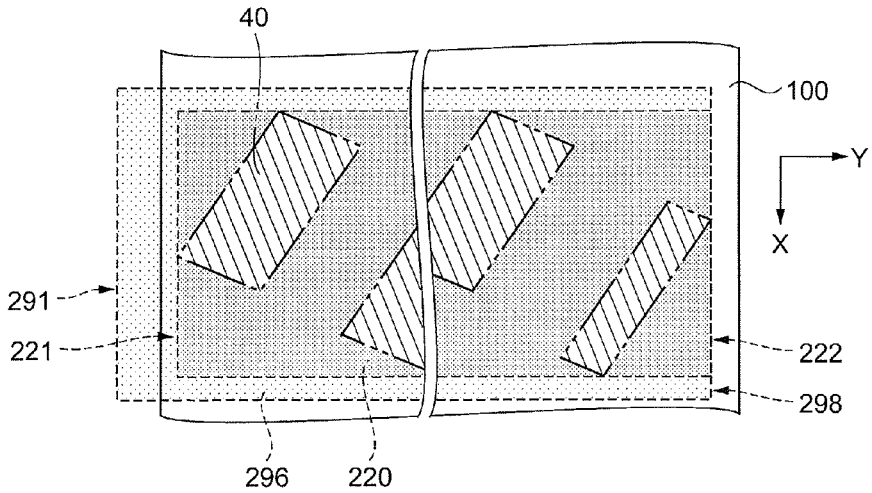

INKJET PRINTER AND CONTROL METHOD FOR INKJET PRINTER

CROSS-REFERENCE TO RELATED APPLICATIONS

This application claims priority to Japanese Patent Application No. 2011-075803 filed on Mar. 30, 2011. The entire disclosure of Japanese Patent Application No. 2011-075803 is hereby incorporated herein by reference.

BACKGROUND

1. Technical Field

The present invention relates to an inkjet printer for printing images onto a printing medium, by ejecting droplets of a liquid so as to cause them to land on the printing medium and dispose the liquid upon the printing medium, and then curing the liquid so disposed; and a control method for the inkjet printer.

2. Related Art

Inkjet devices that eject droplets of a liquid from an ejection head and cause them to land accurately at chosen positions in order to dispose the liquid in chosen quantities at the chosen positions are known in the art. Such inkjet devices are employed as film-forming devices that, by curing the disposed liquid, can form functional films having exact shapes, detailed images, or the like.

Japanese Laid-Open Patent Application Publication No. 2003-80687 discloses an electronic component manufacturing device and an electronic component manufacturing method having a step in which ink of adjusted viscosity is ejected from ejection ports of an inkjet head and applied onto a printing material, and some or all of the applied ink is cured before the ink begins to bleed, making possible markings of small alphanumeric characters or symbols.

However, according to the method disclosed in the above mentioned publication, the curing light, such as infrared or the like, which is used for the purpose of curing the ink or other such liquid also irradiates portions other than those requiring irradiation with the curing light. For example, if the vicinity of the ejection ports of the inkjet head is irradiated with the curing light, curing of the liquid may proceed inside the ejection ports, resulting in a loss of ability to eject in proper fashion. Additionally, if the printing medium is irradiated, due to thermal expansion caused by the heat energy supplied by the irradiating curing light, it is possible that only the irradiated portion will deform. It is accordingly preferable to limit the area irradiated by the curing light to the necessary range only.

Japanese Patent No. 3855724 discloses an inkjet printer provided with a linear encoder for acquiring information about a printing section, and UV irradiation range controlling means that, based on position information about the printing section acquired by the linear encoder, controls UV irradiation by UV irradiation means in such a way that the UV irradiation range of the UV irradiation means lies within the range in which the UV ink was ejected, thereby preventing unwanted portions from being irradiated with UV; and a control method for the same.

SUMMARY

However, with the device or method disclosed in Japanese Patent No. 3855724, in a case in which a malfunction has arisen in the linear encoder, UV irradiation will be carried out based on erroneous position information about the printing section, therefore leading to the problem of a high probability of inappropriate portions being irradiated with UV as well. Additionally, in a case in which a malfunction has arisen in the mover device of the UV irradiation means, the moving speed of the UV irradiation means with respect to the object being irradiated is inappropriate, causing the positions being irradiated to be irradiated with UV for an inappropriate time, leading to the problem of an inappropriate dose of irradiated UV. Particularly where the same given portion continues to be irradiated with curing light, a rise in temperature or the like caused by excessive irradiation with curing light has led to the problem of a high probability of damage to the printing medium.

It is an object of the present invention to address the afore-described problems at least in part through the following aspects.

An inkjet printer includes a medium retaining part, an ejection head, a curing-light-emitting part, a head retaining part, a relative scanning part, a drive output detecting part and a curing-light-emission-control part. The medium retaining part is configured and arranged to retain a printing medium on which a photocuring liquid is disposed and printing is performed. The ejection head is configured and arranged to eject the liquid towards the printing medium retained by the medium retaining part. The curing-light-emitting part is configured and arranged to emit curing light at the printing medium retained by the medium retaining part to facilitate curing of the liquid. The head retaining part is configured and arranged to retain the ejection head and the curing-light-emitting part. The relative scanning part is configured and arranged to perform relative movement of the printing medium and the ejection head, and to perform relative movement of the head retaining part and the medium retaining part in an ejection scanning direction which is a direction of relative movement of the ejection head and the printing medium during ejection scanning in which the liquid is ejected from the ejection head and made to land on the printing medium. The drive output detecting part is configured and arranged to detect an output of a drive source of the relative scanning part. The curing-light-emission-control part is configured to control the curing-light-emitting part to emit the curing light, the curing-light-emission-control part being configured to place the curing-light-emitting part in an emission-enabled state in which the curing light is emitted or in an emission-disabled state in which the curing light is not emitted based on a detection result from the drive output detecting part.

With the inkjet printer according to the present aspect, the curing-light-emission-control part controls the curing-light-emitting part based on the result detected by the drive output detecting part, regarding the output of the drive source of the relative scanning part. The output of the drive source represents an output resulting from operation of the drive source, and as such reflects the operating state of the drive source, specifically, the operating state of the relative scanning part. The curing-light-emitting part experiences relative movement, brought about by the relative scanning part, with respect to the medium retaining part which retains the printing medium; and therefore experiences relative movement through operation of the drive source of the relative scanning part. Consequently, by detecting the operating state of the drive source, the state of relative movement of the curing-light-emitting part with respect to the printing medium can be detected. The state of relative movement of the curing-light-emitting part may refer, for example, to the speed of relative movement of the curing-light-emitting part, to the distance of relative movement derived by integration of the speed of relative movement, or to relative position either during relative movement or subsequent to relative movement, derived from an original relative position and the distance of relative movement. By emitting curing light towards a predetermined position of the printing medium, the curing-light-emitting part irradiates the facing portion with curing light. Consequently, an appropriate operating state of the curing-light-emitting part is determined by the state of relative movement of the curing-light-emitting part with respect to the printing medium. Therefore, by controlling the curing-light-emitting part based on the result detected regarding the output of the drive source, the curing-light-emitting part can be operated in an appropriate operating state.

In the inkjet printer of the aforedescribed aspect, the curing-light-emission-control part is preferably configured to place the curing-light-emitting part in the emission-enabled state when the output of the drive source is equal to or greater than a first output value.

With this inkjet printer, under control by the curing-light-emission-control part, the curing-light-emitting part is placed in the emission-enabled state in cases in which the output of the drive source is equal to or greater than a first output value.

During ejection scanning, the relative scanning part transitions from a halted state to an accelerating state when the ejection scanning starts, then enters a constant-speed scan state, a decelerating state, and finally a halted state. When the relative scanning part enters the halted state, the ejection scanning finishes. Ejection of liquid from the ejection head, and emission of curing light from the curing-light-emitting part as it moves in tandem with the ejection head, are carried out with the relative scanning part in the constant-speed scan state.

The output of the drive source of the relative scanning part is greater when the relative scanning part is in the constant-speed scan state, as compared with when the relative scanning part is in the halted state. In a case in which the output of the drive source of the relative scanning part is less than a predetermined value, because the relative scanning part is not in the constant-speed scan state, it is preferable to not carry out emission of curing light from the curing-light-emitting part, i.e., to place the curing-light-emitting part in the emission-disabled state. By placing the curing-light-emitting part in the emission-enabled state in a case in which the output of the drive source is equal to or greater than a first output value, instances in which the curing-light-emitting part is placed in the emission-enabled state, despite it being preferable for the curing-light-emitting part to be placed in the emission-disabled state, can be minimized.

In the inkjet printer of the aforedescribed aspect, the curing-light-emission-control part is preferably configured to switch the curing-light-emitting part from the emission-disabled state to the emission-enabled state when the output of the drive source has transitioned from less than a first output value to equal to or greater than the first output value, and the curing-light-emission-control part is preferably configured to switch the curing-light-emitting part from the emission-enabled state to the emission-disabled state when the output of the drive source has transitioned from equal to or greater than the first output value to less than the first output value.

With this inkjet printer, in a case in which the output of the drive source has transitioned from less than a first output value to equal to or greater than the first output value, the curing-light-emitting part is placed in the emission-enabled state; and in a case in which the output of the drive source has transitioned from equal to or greater than the first output value to less than the first output value, the curing-light-emitting part is placed in the emission-disabled state.

During ejection scanning, the relative scanning part transitions from a halted state to an accelerating state when the ejection scanning starts, then enters a constant-speed scan state, a decelerating state, and finally a halted state. When the relative scanning part enters the halted state, the ejection scanning finishes. Ejection of liquid from the ejection head, and emission of curing light from the curing-light-emitting part as it moves in tandem with the ejection head, are carried out with the relative scanning part in the constant-speed scan state.

The output of the drive source of the relative scanning part is greater when the relative scanning part is in the constant-speed scan state, as compared with when the relative scanning part is in the halted state. During transition of the output of the drive source from less than the first output value to equal to or greater than the first output value, a case in which the output of the drive source is less than the first output value may represent, for example, a state in which the relative scanning part has not yet reached the constant-speed scan state, and in such a case it is preferable to place the curing-light-emitting part in the emission-disabled state. By placing the curing-light-emitting part in the emission-enabled state in a case in which the output of the drive source has transitioned from less than the first output value to equal to or greater than the first output value, instances in which the curing-light-emitting part is placed in the emission-enabled state, despite it being preferable for the curing-light-emitting part to be placed in the emission-disabled state, can be minimized.

During transition of the output of the drive source from equal to or greater than the first output value to the less than the first output value, a case in which the output of the drive source is less than the first output value may represent, for example, a state in which the relative scanning part has transitioned from the constant-speed scan state to a decelerating state, and in such a case it is preferable to place the curing-light-emitting part in the emission-disabled state. By placing the curing-light-emitting part in the emission-disabled state in a case in which the output of the drive source has transitioned from equal to or greater than the first output value to less than the first output value, instances in which the curing-light-emitting part remains in the emission-enabled state, despite it being preferable for the curing-light-emitting part to be placed in the emission-disabled state, can be minimized.

In the inkjet printer of the aforedescribed aspect, when the output of the drive source has transitioned from less than a first output value to equal to or greater than the first output value, the curing-light-emission-control part is preferably configured to switch the curing-light-emitting part from the emission-disabled state to the emission-enabled state subsequent to a predetermined delay time after a transition timing of the output of the drive source from less than the first output value to equal to or greater than the first output value.

With this inkjet printer, the curing-light-emitting part is placed in the emission-enabled state subsequent to a predetermined delay time following the point in time that the output of the drive source transitioned from less than the first output value to equal to or greater than the first output value.

During ejection scanning, the relative scanning part transitions from a halted state to an accelerating state when the ejection scanning starts, then enters a constant-speed scan state, a decelerating state, and finally a halted state. When the relative scanning part enters the halted state, the ejection scanning finishes. Ejection of liquid from the ejection head, and emission of curing light from the curing-light-emitting part as it moves in tandem with the ejection head, are carried out with the relative scanning part in the constant-speed scan state.

The output of the drive source of the relative scanning part is greater when the relative scanning part is in the constant-speed scan state, as compared with when the relative scanning part is in the halted state. During transition of the output of the drive source from less than the first output value to equal to or greater than the first output value, a case in which the output of the drive source is less than the first output value may represent, for example, a state in which the relative scanning part has not yet reached the constant-speed scan state, and in such a case it is preferable to place the curing-light-emitting part in the emission-disabled state.

The point in time that the output of the drive source transitions from less than the first output value to equal to or greater than the first output value represents a point in time that precedes, by a given time interval, the point in time at which the relative scanning part reaches the constant-speed scan state. The point in time at which the ejection head can start to eject should be a point in time at which the relative scanning part has entered the constant-speed scan state, so that printing may be carried out appropriately. Consequently, it is preferable to start ejection after a given delay time following the point in time that the relative scanning part entered the constant-speed scan state. The point in time at which it is necessary for the curing-light-emitting part to enter the emission-enabled state is a point in time at which the curing-light-emission-control part reaches a position facing the ejected liquid which has landed. Consequently, the point in time at which it is necessary for the curing-light-emitting part to enter the emission-enabled state is a point in time delayed by given time from the point in time that the ejection head can begin ejection. In this way, the point in time at which it is necessary for the curing-light-emitting part to enter the emission-enabled state is a point in time that is a given time after the point in time that the output of the drive source transitions from less than the first output value to equal to or greater than the first output value.

By placing the curing-light-emitting part in the emission-enabled state subsequent to a predetermined delay time following the point in time that the output of the drive source transitioned from less than the first output value to equal to or greater than the first output value, the duration for which the curing-light-emitting part enters the emission-enabled state prior to the point in time at which it is necessary for the curing-light-emitting part to enter the emission-enabled state can be minimized.

In the inkjet printer of the aforedescribed aspect, in preferred practice, the curing-light-emission-control part is preferably configured to switch the curing-light-emitting part from the emission-enabled state to the emission-disabled state at a timing at which a predetermined time interval has elapsed since the curing-light-emitting part was placed in the emission-enabled state.

With this inkjet printer, the curing-light-emission-control part places the curing-light-emitting part in the emission-disabled state, at a point in time at which a predetermined time interval has elapsed since the point in time that the curing-light-emitting part was placed in the emission-enabled state.

During ejection scanning, the relative scanning part transitions from a halted state to an accelerating state when the ejection scanning starts, then enters a constant-speed scan state, a decelerating state, and finally a halted state. When the relative scanning part enters the halted state, the ejection scanning finishes. The time interval in which the operating state of the relative scanning part varies in this manner is generally constant in each single ejection scan, and the point in time at which it is necessary to keep the curing-light-emitting part in the emission-enabled state is generally constant as well. Consequently, the time interval from the point in time that the curing-light-emitting part was placed in the emission-enabled state to the point in time of transition to the emission-disabled state is generally constant. For this reason, by placing the curing-light-emitting part in the emission-disabled state at a point in time at which a predetermined time interval has elapsed since the point in time that the curing-light-emitting part was placed in the emission-enabled state, the curing-light-emitting part can be placed in the emission-disabled state at an appropriate point in time.

In the inkjet printer of the aforedescribed aspect, the curing-light-emission-control part is preferably configured to switch the curing-light-emitting part from the emission-enabled state to the emission-disabled state when the output of the drive source is equal to or greater than a second output value.

With this inkjet printer, in a case in which the output of the drive source is equal to or greater than a second value, the curing-light-emitting part is placed in the emission-disabled state. In a case in which a malfunction has arisen in the relative scanning part, the output of the drive source is greater than normal, due to the excessive load on the drive source. By placing the curing-light-emitting part in the emission-disabled state in a case in which the output of the drive source is equal to or greater than a second value, instances in which the curing-light-emitting part continues to emit curing light while a malfunction has arisen in the relative scanning part can be minimized.

In the inkjet printer of the aforedescribed aspect, the drive source of the relative scanning part is preferably an electric motor, the drive output detecting part is preferably an electrical current measurement device, and the output of the drive source is preferably a current value of a drive power supplied to the electric motor.

With this inkjet printer, the drive source of the relative scanning part is an electric motor, and the output of the drive source is the current value of the drive power supplied to the electric motor. The current value of the drive power supplied to the electric motor fluctuates with the load on the electric motor. Therefore, the operating condition of the electric motor can be detected by detected the current value.

In the inkjet printer of the aforedescribed aspect, the first output value is preferably a current value that is a product of a predetermined positive value smaller than 1 multiplied by the current value of the drive power supplied to the electric motor when a speed of the relative movement of the head retaining part and the printing medium during the ejection scanning is a predetermined constant speed.

With this inkjet printer, the first output value is a current value equivalent to the current value supplied to the electric motor while the relative speed of movement of the head retaining part and the printing medium during the ejection scanning is a predetermined constant speed, multiplied by a predetermined positive value smaller than 1.

During ejection scanning, the relative scanning part transitions from a halted state to an accelerating state when the ejection scanning starts, then enters a constant-speed scan state, a decelerating state, and finally a halted state. When the relative scanning part enters the halted state, the ejection scanning finishes. Emission of curing light from the curing-light-emitting part is carried out with the relative scanning part in the constant-speed scan state. In the constant-speed scan state, the relative speed of movement of the head retaining part and the printing medium is a predetermined constant speed.

In a case in which the detected current value is equal to the current value supplied to the electric motor when the relative speed of movement of the head retaining part and the printing medium during the ejection scanning is a predetermined constant speed, the relative scanning part is in the constant-speed scan state. In a case in which the electric motor is in the halted state, the supplied current value is 0, and therefore by comparing the detected current value to a value slightly lower than the current value that is supplied to the electric motor while at constant speed, it can be detected that the relative scanning part is in the constant-speed scan state. By selecting a first output value that is a current value equivalent to the current value supplied to the electric motor while the relative speed of movement of the head retaining part and the printing medium during the ejection scanning is a predetermined constant speed, multiplied by a predetermined value smaller than 1, the detected current value can be compared to the first output value to determine whether the relative scanning part is in the constant-speed scan state. In order to correctly determine whether the relative scanning part is in the constant-speed scan state, it is preferable for the predetermined value that is less than 1 and intended to be multiplied by the current value supplied to the electric motor while the relative scanning part is in the constant-speed scan state, to be close to 1. In consideration of the range of fluctuation of the current value supplied to the electric motor while the relative scanning part is in the constant-speed scan state, the predetermined value smaller than 1 is preferably set to a value close to 1.

In the inkjet printer of the aforedescribed aspect, the drive source of the relative scanning part is preferably an electric motor, the drive output detecting part is preferably an electrical current measurement device, the output of the drive source is preferably the current value of the drive power supplied to the electric motor, and the second output value is preferably a current value that is less than a locked current when the electric motor is in a locked state, and greater than the current value of the drive power supplied to the electric motor when a speed of the relative movement of the head retaining part and the printing medium during the ejection scanning is a predetermined constant speed.

With this inkjet printer, the second output value is a current value that is less than the locked current when the electric motor is in a locked state, and greater than the current value of the drive power supplied to the electric motor while the relative speed of movement of the head retaining part and the printing medium during the ejection scanning is a predetermined constant speed. In a case in which the detected current value is greater than the second output value, the curing-light-emitting part is placed in the emission-disabled state.

In a case in which the detected current value is greater than the second output value, which is less than the locked current of the electric motor, the curing-light-emitting part is placed in the emission-disabled state. In so doing, in a case of flow of locked current or of current of a current value close to the locked current due to the electric motor having been forcibly brought to halt or largely to a halt by application of a high load, the curing-light-emitting part can be placed in the emission-disabled state.

In a case in which the detected current value is greater than the second output value, which is greater than the current value of the drive power supplied to the electric motor while the relative speed of movement of the head retaining part and the printing medium during the ejection scanning is a predetermined constant speed, the curing-light-emitting part is placed in the emission-disabled state. Therefore, in a case in which the relative scanning part is in the constant-speed scan state, instances in which the curing-light-emitting part is placed in the emission-disabled state due to the detected current value exceeding the second output value can be substantially eliminated.

A method according to another aspect of the present invention is a method for controlling an inkjet printer including a medium retaining part for retaining a printing medium on which a photocuring liquid is disposed and printing is performed, an ejection head for ejecting the liquid towards the printing medium retained by the medium retaining part, a curing-light-emitting part for emitting curing light at the printing medium retained by the medium retaining part to facilitate curing of the liquid, a head retaining part for retaining the ejection head and the curing-light-emitting part, and a relative scanning part for performing relative movement of the printing medium and the ejection head and performing relative movement of the head retaining part and the medium retaining part in an ejection scanning direction which is a direction of relative movement of the ejection head and the printing medium during ejection scanning in which the liquid is ejected from the ejection head and made to land on the printing medium. The method includes: detecting an output of a drive source of the relative scanning part; and controlling the curing-light-emitting part to place the curing-light-emitting part in an emission-enabled state in which the curing light is emitted or in an emission-disabled state in which the curing light is not emitted based on a detection result in the detecting of the output of the drive source.

With the control method for an inkjet printer according to the present aspect, in the emission control step, the curing-light-emitting part is controlled based on the detection result of the output of the drive source of the relative scanning part in the drive output detection step. The output of the drive source represents an output resulting from operation of the drive source, and as such reflects the operating state of the drive source, specifically, the operating state of the relative scanning part. The curing-light-emitting part experiences relative movement, brought about by the relative scanning part, with respect to the medium retaining part which retains the printing medium; and therefore experiences relative movement through operation of the drive source of the relative scanning part. Consequently, by detecting the operating state of the drive source, the state of relative movement of the curing-light-emitting part with respect to the printing medium can be detected. The state of relative movement of the curing-light-emitting part may refer, for example, to the speed of relative movement of the curing-light-emitting part, to the distance of relative movement derived by integration of the speed of relative movement, or to relative position either during relative movement or subsequent to relative movement, derived from an original relative position and the distance of relative movement. By emitting curing light towards a predetermined position of the printing medium, the curing-light-emitting part irradiates the facing portion with curing light. Consequently, an appropriate operating state of the curing-light-emitting part is determined by the state of relative movement of the curing-light-emitting part with respect to the printing medium. Therefore, by controlling the curing-light-emitting part based on the detection result of the output of the drive source, the curing-light-emitting part can be operated in an appropriate operating state.

BRIEF DESCRIPTION OF THE DRAWINGS

Referring now to the attached drawings which form a part of this original disclosure:

FIG. 8A is a descriptive diagram showing temporal change of the scanning speed of the carriage unit, FIG. 8B is a descriptive diagram showing temporal change of drive current in association with temporal change of the scanning speed of the carriage unit, as well as showing UV LED ON times and OFF times, and FIG. 8C is a descriptive diagram showing the positional relationship of the leading edge and the trailing edge of a target landing area in a single ejection scan, and the leading edge and the trailing edge of a UV irradiation area;

FIG. 9A is a descriptive diagram showing temporal change of the scanning speed of the carriage unit, FIG. 9B is a descriptive diagram showing temporal change of drive current in correspondence with temporal change of the scanning speed of the carriage unit, as well as showing UV LED ON times and OFF times, and FIG. 9C is a descriptive diagram showing the positional relationship of the leading edge and the trailing edge of a target landing area in a single ejection scan, and the leading edge and the trailing edge of a UV irradiation area.

DETAILED DESCRIPTION OF EXEMPLARY EMBODIMENTS

Figure 1A:
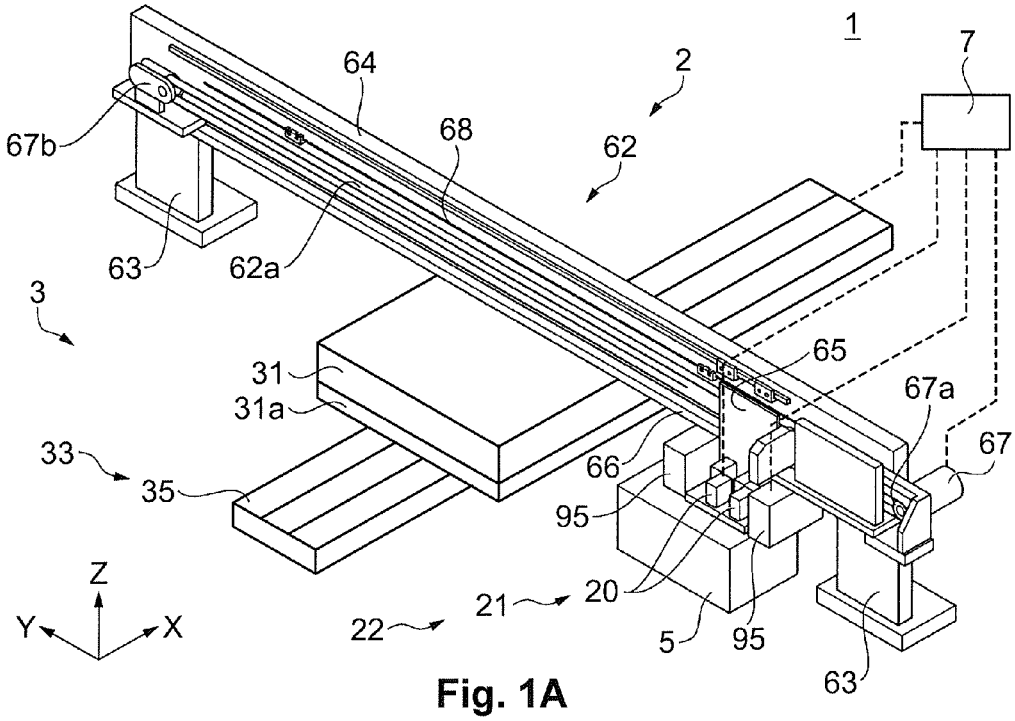
FIG. 1A is perspective view showing a simplification of the general scheme of a liquid droplet ejection device.

An embodiment of the inkjet printer and the inkjet printer control process are described below with reference to the drawings. The present embodiment describes an example of a liquid droplet ejection device provided with liquid droplet ejection heads of inkjet format, and which employs the liquid droplet ejection heads to print an image onto a printing medium. The liquid droplet ejection device is adapted to bring about relative movement of the liquid droplet ejection heads and the printing medium, as well as to eject droplets of a functional liquid from the ejection nozzles of the liquid droplet ejection heads so as to land at predetermined positions on the printing medium, and form a predetermined image. As the functional liquid, there may be employed a functional liquid photocuring type that cures by irradiation with curing light. The curing light may be ultraviolet, for example, and the functional liquid may be an ultraviolet-curing functional liquid.

In the drawings to which reference is made in the following description, the longitudinal and transverse scale of members and portions shown may differ from the actual ones, for convenience in illustration.

The liquid droplet ejection device corresponds to the inkjet printer. The functional liquid corresponds to the liquid.

Liquid Droplet Ejection Device

Figure 1B:
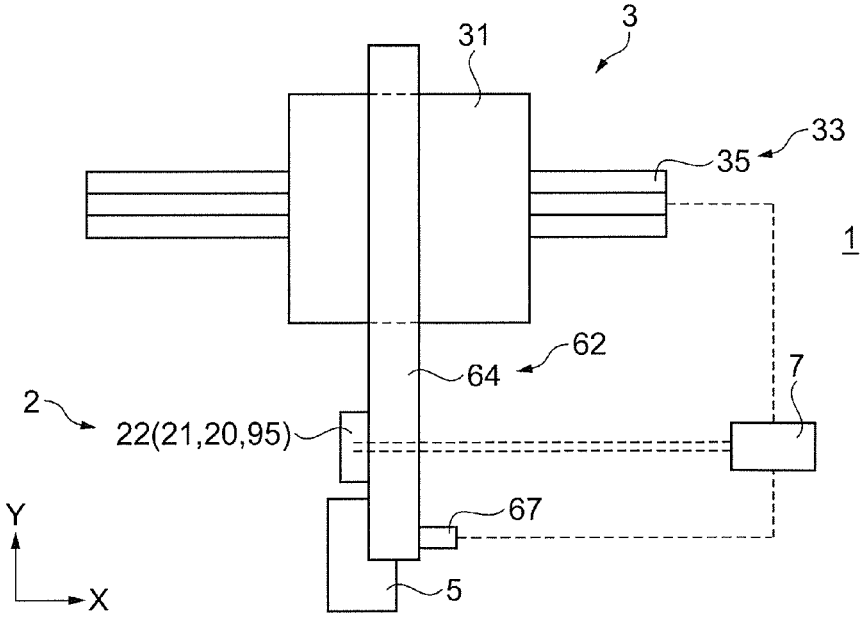
FIG. 1B is a plan view showing a simplification of the general scheme.

Firstly, the general scheme of a liquid droplet ejection device 1 is described with reference to FIG. 1. FIG. 1 is a descriptive diagram showing a simplification of the general scheme of the liquid droplet ejection device. FIG. 1A is perspective view showing a simplification of the general scheme of a liquid droplet ejection device, and FIG. 1B is a plan view showing a simplification of the general scheme.

As shown in FIG. 1, the liquid droplet ejection device 1 is provided with a head mechanism section 2, a medium mechanism section 3, a maintenance device section 5, and an ejection device controller 7. The head mechanism section 2 has liquid droplet ejection heads 20 for ejecting droplets of a functional liquid. The liquid droplet ejection device 1 is also provided with a functional liquid supply section and an ejection testing device section, not shown. The functional liquid ejected by the liquid droplet ejection heads 20 is supplied to the liquid droplet ejection heads 20 by the functional liquid supply section. The device controller 7 exercises overall control of the aforedescribed mechanism sections. The liquid droplet ejection heads 20 corresponds to the ejection heads.

The head mechanism section 2 is provided with a carriage unit 22 and a carriage scanning mechanism 62. The carriage unit 22 is provided with a head unit 21 having the liquid droplet ejection heads 20, and ultraviolet irradiation sections 95 for irradiating with ultraviolet. The carriage scanning mechanism 62 is provided with a carriage frame 65 from which the carriage unit 22 is suspended. The carriage unit 22 is moved in the Y axis direction by moving the carriage frame 65 in the Y axis direction.

The carriage scanning mechanism 62 is provided with support posts 63, a support beam 64, a guide section 66, a drive motor 67, a drive pulley 67*a*, a driven pulley 67*b*, a belt 62*a*, the carriage frame 65, and an encoder 68.

The support beam 64 is furnished so as to span the two support posts 63, and extends in the Y axis direction. The guide section 66 is secured to the support beam 64, and extends in the Y axis direction. The drive motor 67 is secured to the support beam 64, in proximity to one end of the support beam 64 in the Y axis direction. The drive pulley 67*a* is secured to the output shaft of the drive motor 67, and the drive pulley 67*a* is rotationally driven by the drive motor 67. The driven pulley 67*b* is rotatably secured to the support beam 64, in proximity to the end thereof on the opposite side from the end where the drive motor 67 is secured in the Y axis direction of the support beam 64. The axial direction of the rotation shaft of the driven pulley 67*b* is approximately parallel to the axial direction of the rotation shaft of the drive pulley 67*a* (the output shaft of the drive motor 67). The belt 62*a* spans the drive pulley 67*a* and the driven pulley 67*b*, and is driven by rotation of the drive pulley 67*a*. The belt 62*a* extends in the Y axis direction, parallel to the guide section 66. The encoder 68 is secured to the support beam 64, and extends in the Y axis direction, approximately parallel to the guide section 66.

The carriage frame 65 is secured to the belt 62*a*. The carriage frame 65 is slidably engaged in the Y axis direction by the guide section 66. Through driving of the belt 62*a* by the drive motor 67, the carriage frame 65 is driven in the Y axis direction across the guide section 66. The position of the carriage frame 65 in the Y axis direction is detected by the encoder 68.

When the carriage frame 65 is moved in the Y axis direction by the carriage scanning mechanism 62, the liquid droplet ejection heads 20 belonging to the head unit 21 suspended from the carriage frame 65 can be adjustably driven in the Y axis direction, and can be retained at any position to which they are moved.

The carriage scanning mechanism 62 corresponds to the relative scanning part. The carriage frame 65 corresponds to the head retaining part. The drive motor 67 corresponds to the drive source.

The medium mechanism section 3 is provided with a medium placement stage 31, a slide stage 31*a*, and a medium moving mechanism 33.

The medium moving mechanism 33 is provided with an X axis guide 35 and an X axis linear motor (not shown). The X axis guide 35 is arranged between the two support posts 63, and extends below the support beam 64 and approximately parallel to the X axis orthogonal to the Y axis.

The slide stage 31*a* is supported on the X axis guide 35 in slidable fashion in the X axis direction. The X axis linear motor is arranged approximately parallel to the X axis guide 35, and the slide stage 31*a* is moved in the X axis direction by the X axis linear motor, and can be retained at any position to which it has moved. By a medium rotating mechanism, not shown, the medium resting stage 31 is secured on the slide stage 31*a* and supported rotatably in a direction about an axis parallel to the Z axis direction orthogonal to X axis direction and the Y axis direction.

As the slide stage 31*a* is moved in the X axis direction by the medium moving mechanism 33, the medium placement stage 31 to which the slide stage 31*a* has been secured and is supported can be adjustably moved in the X axis direction, and can be retained at any position to which it has moved. Specifically, the printing medium retained on the medium placement stage 31 can be adjustably moved in the X axis direction, and can be retained at any position to which it has moved.

The medium placement stage 31 corresponds to the medium retaining part.

In the head mechanism section 2, the liquid droplet ejection head 20*s* belonging to the head unit 21 which is suspended from the carriage frame 65 are retained in such a way that their nozzle substrate 25 (see FIG. 2) faces downward. The printing medium retained on the medium placement stage 31 is moved to and halted at a position opposing the liquid droplet ejection heads 20 in the X axis direction, and droplets of the functional liquid are ejected in synchronization with movement in the Y axis direction by the liquid droplet ejection heads 20 (the head unit 21) thereabove. Through relative control of the printing medium or a testing medium moving in the X axis direction and of the liquid droplet ejection heads 20 moving the Y axis direction, droplets are made to land at selected positions on the printing medium or testing medium, thereby making it possible to print a desired planar shape.

In the carriage unit 22, one ultraviolet irradiating section 95 for curing the ultraviolet-curing functional liquid is arranged to each side of the head unit 21 in the Y axis direction. An image printed employing the ultraviolet-curing functional liquid can be cured employing the ultraviolet irradiating sections 95. The ultraviolet irradiating sections 95 correspond to the curing-light-emitting part. The step of ejecting droplets of the functional liquid in synchronization with movement in the Y direction by the liquid droplet ejection heads 20 (the head unit 21) corresponds to ejection scanning.

The ejection device controller 7 is electrically connected to the liquid droplet ejection heads 20, the ultraviolet irradiating sections 95, the drive motor 67 of the carriage scanning mechanism 62, the X-axis linear motor of the medium moving mechanism 33, and so on. Signals are sent from a controller provided to the ejection device controller 7, to operate the liquid droplet ejection heads 20, the ultraviolet irradiating sections 95, the drive motor 67 of the carriage scanning mechanism 62, the X-axis linear motor, and so on.

The maintenance device section 5 is provided with several types of maintenance devices. The maintenance devices are devices for carrying out various types of maintenance on the liquid droplet ejection heads 20. When carrying out maintenance of the liquid droplet ejection heads 20, the head unit 21 (the liquid droplet ejection heads 20) is moved to a position facing the maintenance device section 5 using the carriage scanning mechanism 62, where a maintenance operation is carried out.

Liquid Droplet Ejection Head

Figure 2A:
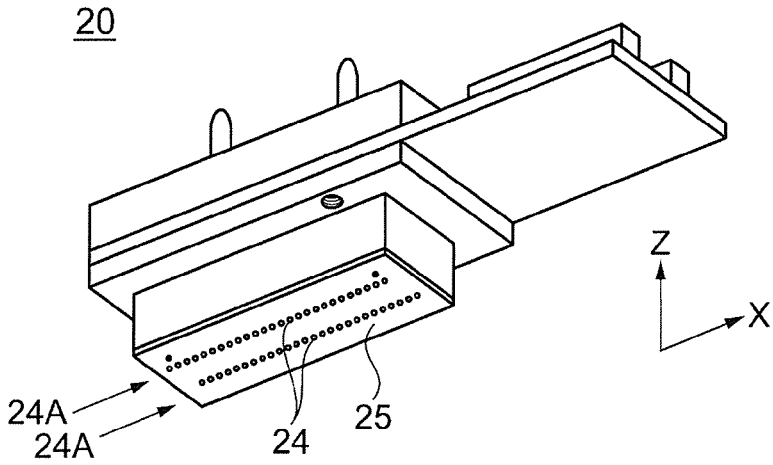
FIG. 2A is an exterior perspective view showing a simplified scheme of a droplet ejection head.
Figure 2B:
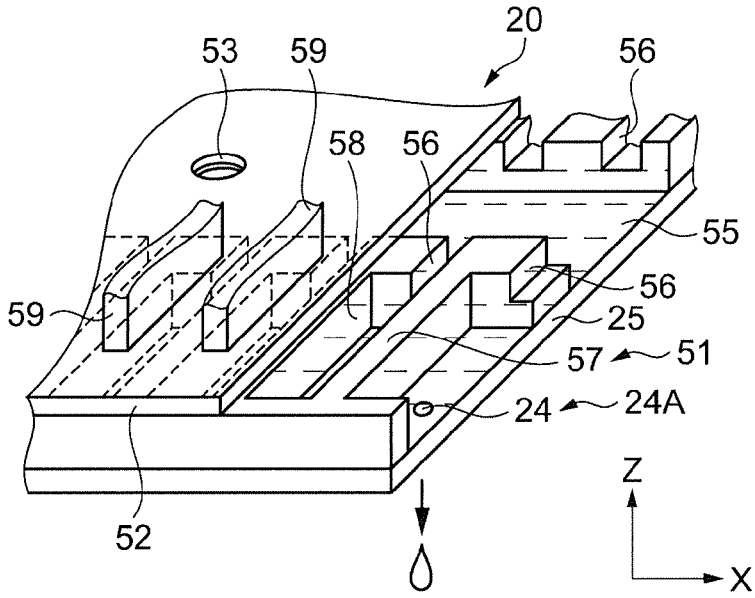
FIG. 2B is a perspective cross sectional view showing the structure of the droplet ejection head.
Figure 2C:
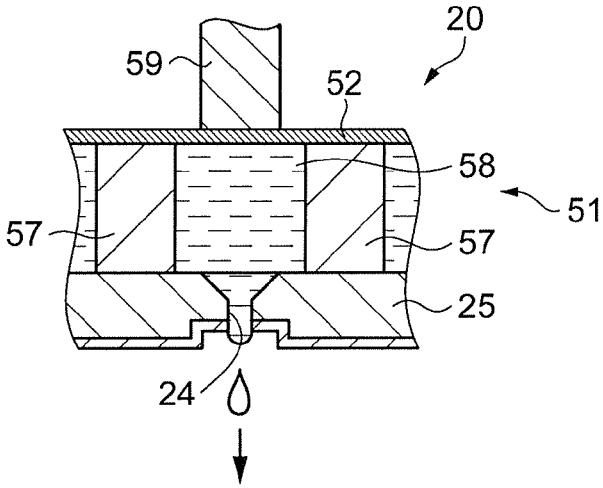
FIG. 2C is a cross sectional view showing the structure of an ejection nozzle portion of the liquid droplet ejection head.

Next, the liquid droplet ejection heads 20 are described with reference to FIG. 2. FIG. 2 is a diagram showing a simplified scheme of a liquid droplet ejection head. FIG. 2A is an exterior perspective view showing a simplified scheme of a liquid droplet ejection head, FIG. 2B is a perspective cross sectional view showing the structure of the liquid droplet ejection head, and FIG. 2C is a cross sectional view showing the structure of an ejection nozzle portion of the liquid droplet ejection head. With the liquid droplet ejection head 20 installed in the liquid droplet ejection device 1, the X axis and Z axis shown in FIG. 2 coincide with the X axis and Z axis shown in FIG. 1.

As shown in FIG. 2A, the liquid droplet ejection head 20 is provided with the nozzle substrate 25. A two nozzle rows 24A of a multitude of ejection nozzles 24 lined up in generally straight lines are formed in the nozzle substrate 25. Droplets of the functional liquid are ejected from the ejection nozzles 24 and made to land at opposed positions on a printing object or the like, thereby disposing the functional liquid at these positions. With the liquid droplet ejection head 20 installed in the liquid droplet ejection device 1, the nozzle rows 24A extend in the X-axis direction shown in FIG. 1. The ejection nozzles 24 are lined up at equidistant nozzle pitch in the nozzle rows 24A; and between the two nozzle rows 24A, the positions of the ejection nozzles 24 are displaced by half of the nozzle pitch in the X-axis direction. Consequently, the liquid droplet ejection head 20 can dispose droplets of the functional liquid at half-nozzle pitch spacing in the X-axis direction. The nozzle pitch is 140 μm, for example, and the half-nozzle pitch is 70 μm.

As shown in FIGS. 2B and 2C, the liquid droplet ejection head 20 includes a pressure chamber plate 51 stacked on the nozzle substrate 25, and an oscillator plate 52 stacked on the pressure chamber plate 51.

A liquid reservoir 55 that is always filled with the functional liquid supplied to the liquid droplet ejection head 20 is formed in the pressure chamber plate 51. The liquid reservoir 55 is a space delineated by the oscillator plate 52, the nozzle substrate 25, and the wall of the pressure chamber plate 51. The functional liquid is supplied from the functional liquid supply section to the liquid droplet ejection head 20, and then supplied to the liquid reservoir 55 through a liquid supply hole 53 in the oscillator plate 52. Pressure chambers 58 partitioned by a plurality of head partition walls 57 are formed in the pressure chamber plate 51. The pressure chambers 58 are spaces delineated by the oscillator plate 52, the nozzle substrate 25, and two of the head partition walls 57.

The pressure chambers 58 are furnished in respectively corresponding fashion to the ejection nozzles 24, with the number of pressure chambers 58 and the number of ejection nozzles 24 being the same. The pressure chambers 58 are supplied with the functional liquid from the liquid reservoir 55 through supply ports 56 positioned between two of the head partition walls 57. Sets of the head partition walls 57, the pressure chambers 58, the ejection nozzles 24, and the supply ports 56 are lined up in a single row across the liquid reservoir 55; ejection nozzles 24 lined up in single rows form the nozzle rows 24A. While not shown in FIG. 2B, one additional nozzle row 24A of ejection nozzles 24 arranged lined up in a single row is formed at a generally symmetrical position in relation to the liquid reservoir 55, with respect to the nozzle rows 24A that include the illustrated nozzles 24. The sets of the head partition walls 57, the pressure chambers 58, and the supply ports 56 corresponding to the nozzle row 24A in question are lined up in a single row.

Piezoelectric elements 59 are respectively secured at one end thereof to the portion of the oscillator plate 52 that constitutes the pressure chambers 58. The piezoelectric elements 59 are secured at the other end, via a securing plate (not shown), to a base (not shown) that supports the entire liquid droplet ejection head 20.

The piezoelectric elements 59 have an active section composed of stacked electrode layers and piezoelectric material. Through application of a drive voltage to the electrode layers, the active section of the piezoelectric element 59 constricts in the lengthwise direction (the thickness direction of the oscillator plate 52 in FIG. 2B or 2C). When the drive voltage applied to the electrode layers ceases, the active section returns to its original length.

By application of a drive voltage to the electrode layers, which causes the active section of the piezoelectric element 59 to constrict, the oscillator plate 52, to which one end of the piezoelectric element 59 has been secured, is subjected to force pulling it towards the opposite side from the pressure chamber 58. Through this pulling of the oscillator plate 52 towards the opposite side from the pressure chamber 58, the oscillator plate 52 is deflected towards the opposite side from the pressure chamber 58. The capacity of the pressure chamber is increased thereby, and therefore the functional liquid is supplied into the pressure chamber 58 from the liquid reservoir 55 through the supply port 56. Next, when the drive voltage applied to the electrode layers ceases, the active section returns to its original length, whereby the piezoelectric element 59 pushes on the oscillator plate 52. Pushed in this way, the oscillator plate 52 returns towards the pressure chamber 58 side. The capacity of the pressure chamber 58 is suddenly reduced thereby. Specifically, because the capacity is reduced by the equivalent of the increase, pressure is applied to the functional liquid filling the interior of the pressure chamber 58, and a drop of the functional liquid is ejected from the ejection nozzle 24 formed in communication with the pressure chamber 58 in question.

Carriage Unit

Figure 3:
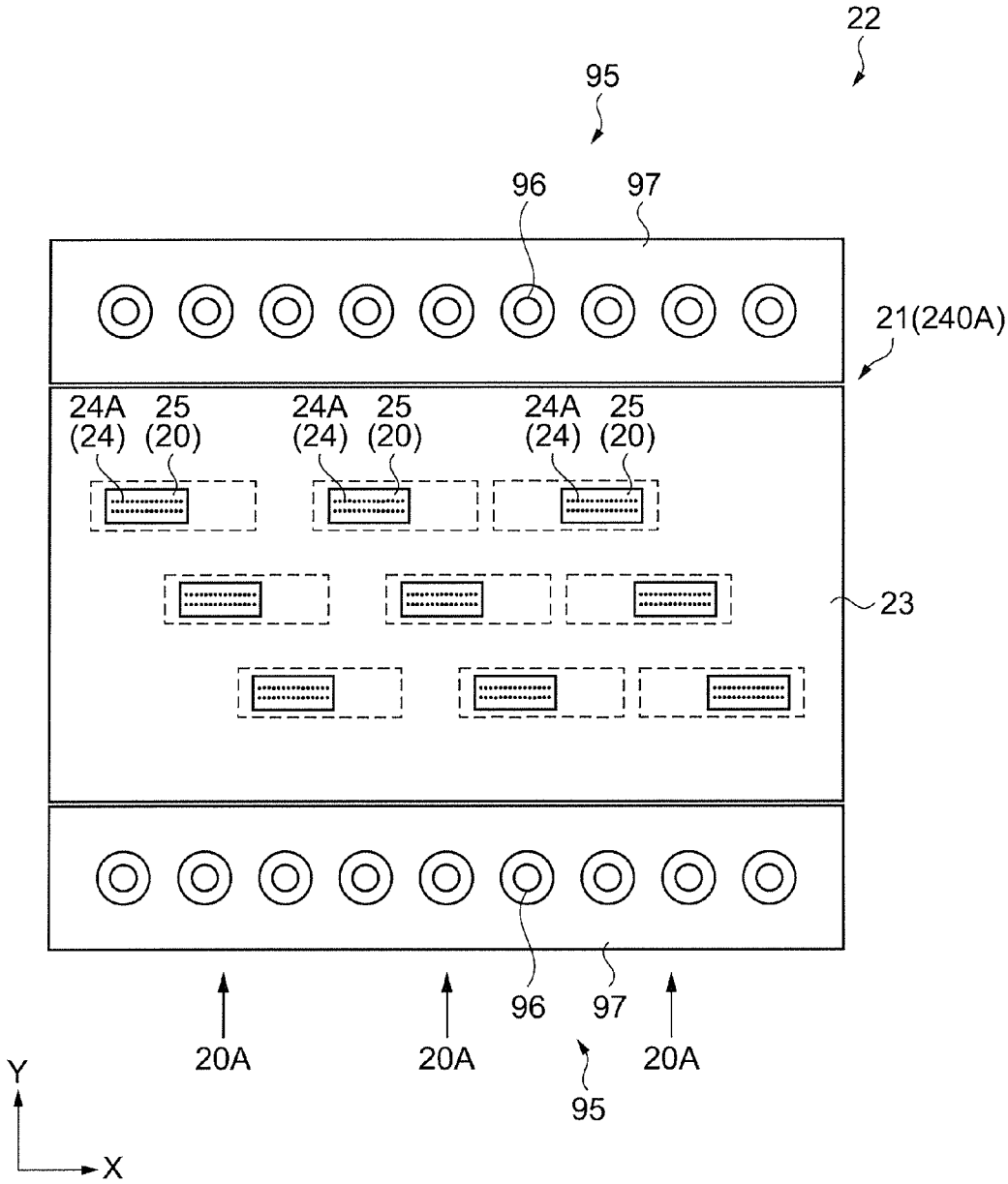
FIG. 3 is a plan view showing a simplified scheme of a carriage unit.

Next, the general scheme of the carriage unit 22 provided to the head mechanism section is described with reference to FIG. 3. FIG. 3 is a plan view showing a simplified scheme of a carriage unit. With the carriage unit 22 installed in the liquid droplet ejection device 1, the X-axis direction and the Y-axis direction shown in FIG. 3 coincide with the X-axis direction and the Y-axis direction shown in FIG. 1.

As shown in FIG. 3, the carriage unit 22 is provided with the head unit 21, and the two ultraviolet irradiation sections 95.

The head unit 21 has a unit plate 23, and nine liquid droplet ejection heads 20 mounted onto the unit plate 23.

The liquid droplet ejection heads 20 are secured to the unit plate 23 via head retaining members, not shown. The secured liquid droplet ejection heads 20 are positioned with the head body thereof fitting freely within holes (not shown) formed in the unit plate 23, and with the nozzle substrate 25 at positions protruding beyond the face of the nozzle plate 23. FIG. 3 is a diagram viewed from the nozzle plate 25 side. The nine liquid droplet ejection heads 20 are grouped in the X-axis direction to form three head sets 20A respectively having three liquid droplet ejection heads 20 each. With the head unit 21 installed in the liquid droplet ejection device 1, the nozzle rows 24A of the respective liquid droplet ejection heads 20 extend in the X-axis direction.

The liquid droplet ejection heads 20 are arranged in the X-axis direction at positions such that the ejection nozzles 24 at an end of one liquid droplet ejection head 20 among mutually adjacent liquid droplet ejection heads 20 are positioned with displacement by one-half the nozzle pitch with respect to the ejection nozzles 24 at an end of another liquid droplet ejection head 20. With the nine liquid droplet ejection heads 20 provided to a single head unit 21 at the same given position in the Y-axis direction, the ejection nozzles 24 line up at equidistant spacing equal to one-half the nozzle pitch in the X-axis direction. Specifically, by design, at the same given position in the Y-axis direction, droplets ejected from the ejection nozzles 24 constituting the respective nozzle rows 24A belonging to the respective liquid droplet ejection heads 20 will land on a straight line, and will line up at equidistant spacing equal to one-half the nozzle pitch in the X-axis direction.

The nozzle rows 24A have, for example, 180 ejection nozzles 24, and the liquid droplet ejection heads 20 have 360 ejection nozzles 24. The head unit 21 having the nine liquid droplet ejection heads 20 has 3240 ejection nozzles 24. The 18 nozzle rows 24A belonging to the nine liquid droplet ejection heads 20 provided to the single head unit 21 can be treated as a single nozzle row as well. Such a nozzle row is denoted as a "unit nozzle row 240A." The unit nozzle row 240A has 3240 ejection nozzles 24. When single droplets are ejected from each of the respective ejection nozzles 24 of the unit nozzle row 240A, and land at the same given position in the Y-axis direction, a straight line of 3240 dots lined up at pitch spacing equivalent to half the nozzle pitch is formed.

The ultraviolet irradiation sections 95 are provided with a support frame (not shown), Ultraviolet Light Emitting Diodes (UV LEDs) 96, and an LED housing 97. The UV LEDs 96 are LEDs for emitting ultraviolet.

The LED housing 97 is secured via the support frame to a side face of the unit plate 23 in the Y-axis direction. The LED housing 97 has contours of generally cuboid shape, with a housing chamber of generally cuboid shape opening onto one face formed inside. The housing chamber opens to the side facing the medium placement stage 31. The UV LEDs 96 are secured within the housing chamber, in such a manner to emit ultraviolet towards the opening. The plurality of UV LEDs 96 are arranged lined up in the X-axis direction. The plurality of UV LEDs 96 can irradiate with ultraviolet a zone that encompasses the breadth of the functional liquid that is disposed in the X-axis direction by the liquid droplet ejection heads 20 of the head unit 21.

The liquid droplet ejection heads 20 correspond to the ejection heads. The ultraviolet irradiation sections 95, or the UV LEDs 96, correspond to the curing-light-emitting part.

As discussed previously, the ultraviolet irradiation sections 95 are arranged to either side of the nine liquid droplet ejection heads 20 in the Y-axis direction (the ejection scanning direction), and are generally symmetrical in relation to the nine liquid droplet ejection heads 20.

During ejection of the functional liquid while the head unit 21 is scanned in the Y-axis direction, the UV LEDs 96 arranged in line with the liquid droplet ejection heads 20 irradiate ultraviolet in generally parallel fashion.

By emitting ultraviolet from the UV LEDs 96 positioned to the back side of the head unit 21 in the scanning direction, the functional liquid which has been ejected and has landed can be irradiated with ultraviolet immediately after having landed. The functional liquid can be cured through irradiation of the functional liquid with ultraviolet. Factors affecting the curing rate of the functional liquid include the scanning speed, the width of the area irradiated by the UV LEDs 96 in the Y-axis direction, the emission intensity of the UV LEDs 96, etc. By establishing appropriate values for these factors, the functional liquid having landed can then be cured at an appropriate curing rate.

Control of Ultraviolet Irradiation

Figure 4:
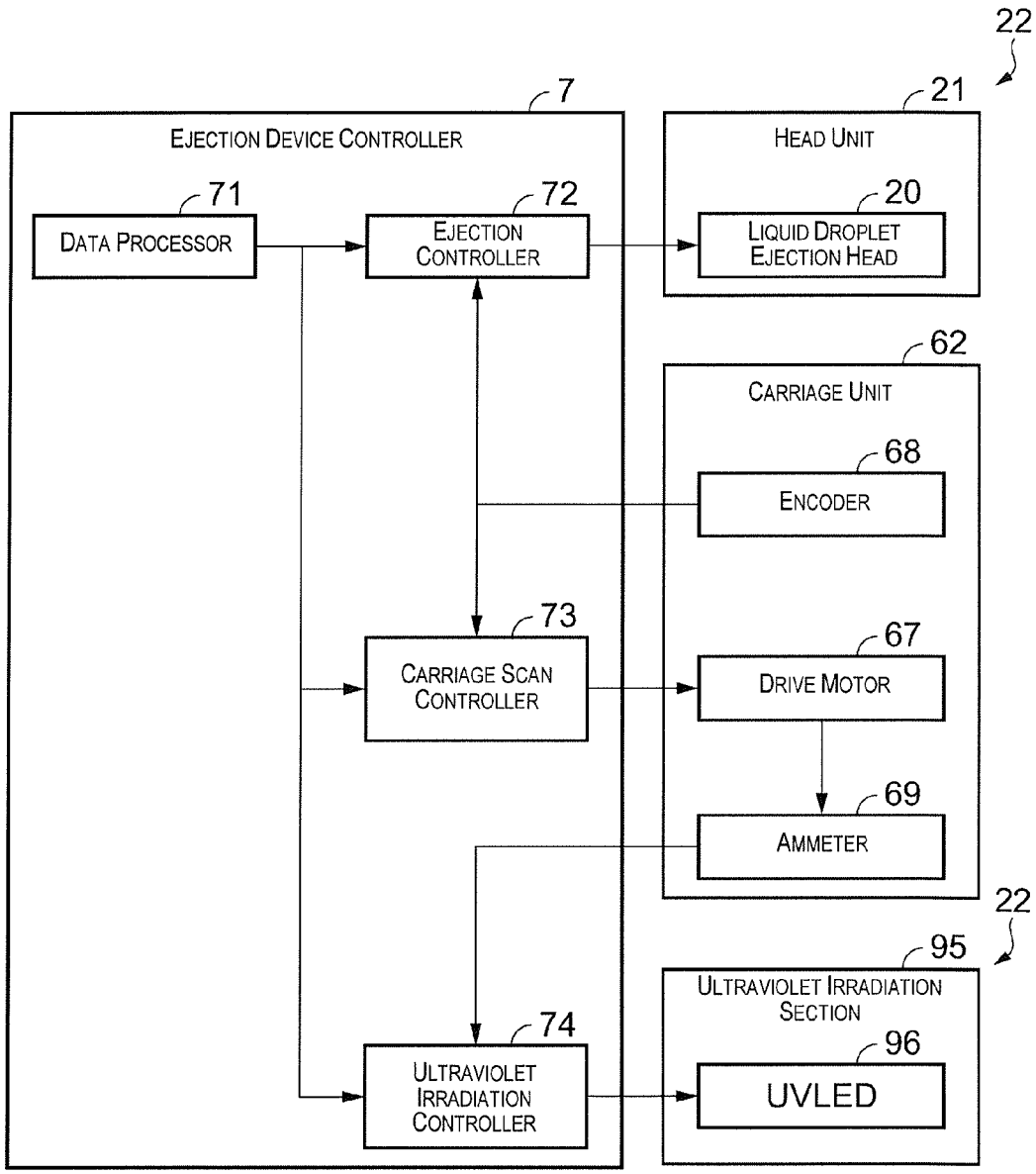
FIG. 4 is a functional schematic block diagram showing the electrical configuration and signal flows in relation to control of ultraviolet irradiation in the liquid droplet ejection device.

Next, a scheme relating to control of ultraviolet irradiation in the liquid droplet ejection device 1 is described with reference to FIG. 4. FIG. 4 is a functional schematic block diagram showing the electrical configuration, and signal flows in relation to control of ultraviolet irradiation in the liquid droplet ejection device.

As discussed previously, the head mechanism section 2 provided to the liquid droplet ejection device 1 is provided with the carriage unit 22 and the carriage scanning mechanism 62. The carriage unit 22 is provided with the head unit 21 having the liquid droplet ejection heads 20, and the ultraviolet irradiation sections 95 for irradiating ultraviolet. The carriage scanning mechanism 62 is provided with the drive motor 67 as the drive source for scanning the carriage unit 22, and the encoder 68 for detecting the position of the carriage unit 22.

As shown in FIG. 4, the ejection device control section 7 is provided with a data processor 71, an ejection controller 72, a carriage scan controller 73, and an ultraviolet irradiation controller 74. The carriage scanning mechanism 62 is provided with an ammeter 69, in addition to the drive motor 67 and the encoder 68 mentioned above.

The ejection controller 72 is electrically connected to the liquid droplet ejection heads 20, and controls the liquid droplet ejection heads 20 to eject the functional liquid. The carriage scan controller 73 is electrically connected to the drive motor 67 of the carriage scanning mechanism 62, and controls the drive motor 67 to move the carriage unit 22. The ultraviolet irradiation controller 74 is electrically connected to the UV LEDs 96 of the ultraviolet irradiation sections 95, and controls the UV LEDs 96 to emit ultraviolet.

The encoder 68 is electrically connected to the ejection controller 72 and the carriage scan controller 73, and transmits position information about the carriage unit 22. The ammeter 69 is electrically connected to the drive motor 67 and the ultraviolet irradiation controller 74, and is adapted to measure the drive current of the drive motor 67, and transmit the result of the measurement to the ultraviolet irradiation controller 74.

The ammeter 69 corresponds to the drive output detecting part or the electrical current measuring device.

Image data for an image to be printed is input to the liquid droplet ejection device 1 via an input device, stored in a storage device provided to the liquid droplet ejection device 1, and transmitted to the data processor 71. From the image data, the data processor 71 extracts data for printing purposes, which is then transmitted to the ejection controller 72, the carriage scan controller 73, and the ultraviolet irradiation controller 74.

From the data processor 71, the carriage scan controller 73 acquires carriage scan data indicating the carriage unit 22 position, which has been extracted from the image data. The carriage scan controller 73 also acquires position information about the carriage unit 22 from the encoder 68. Based on the carriage scan data and the position information about the carriage unit 22, the carriage scan controller 73 drives the drive motor 67 and scans the carriage unit 22. Specifically, the liquid droplet ejection heads 20 and the UV LEDs 96 are scanned in the Y-axis direction, which is the ejection scanning direction. The encoder 68 provides the carriage scan controller 73 with feedback of position information about the scanned carriage unit 22.

From the data processor 71, the ejection controller 72 acquires liquid droplet ejection data indicating positions for ejection of liquid droplets of the functional liquid, which has been extracted from the image data. The ejection controller 72 also acquires position information about the carriage unit 22 from the encoder 68. The position information about the carriage unit 22 is position information about the liquid droplet ejection heads 20; from this information, position information about the respective ejection nozzles 24 of the liquid droplet ejection heads 20 may be obtained. Based on the ejection data and the position information about the carriage unit 22, ejection controller 72 ejects liquid droplets of the functional liquid from the ejection nozzles 24 positioned at the ejection positions which have been specified by the ejection data.

From the data processor 71, the ultraviolet irradiation controller 74 acquires ultraviolet irradiation data indicating positions for irradiation with curing light, which has been extracted from the image data. From the ammeter 69, the ultraviolet irradiation controller 74 also acquires the drive current value of the drive motor 67. The drive current of the drive motor 67 is generated by applying a drive voltage to the drive motor 67, and differs depending on the load on the drive motor 67. Therefore, the operating state of the drive motor 67 can be detected from the drive current, and the state of the carriage unit 22 can be detected. The state of the carriage unit 22 may refer to the speed of movement of the carriage unit 22; to the distance of movement thereof derived by integration of the speed of movement; or to position either during movement or subsequent to movement, derived from an original position and the distance of movement.

Based on the ultraviolet irradiation data and the drive current value, the ultraviolet irradiation controller 74 controls the UV LEDs 96, causing them to emit ultraviolet towards the positions for irradiation specified in the ultraviolet irradiation data. The ultraviolet irradiation controller 74 corresponds to the curing-light-emission-control part.

Landing Positions

Figure 5A:
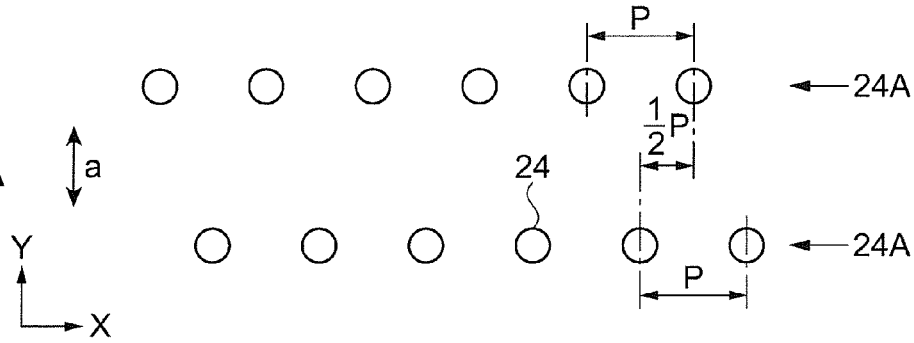
FIG. 5A is a descriptive diagram showing positions of disposition of ejection nozzles.
Figure 5B:
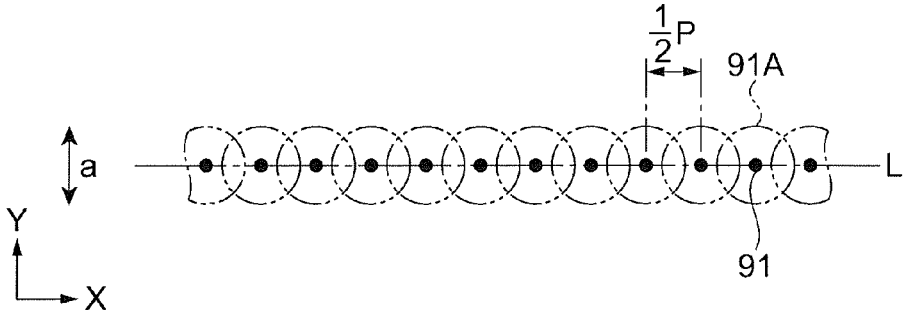
FIG. 5B is a descriptive diagram showing droplets having landed in a linear pattern in the direction of extension of a nozzle row.
Figure 5C:
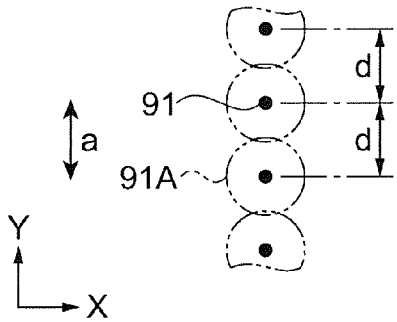
FIG. 5C is a descriptive diagram showing droplets having landed in a linear pattern in a main scanning direction.
Figure 5D:
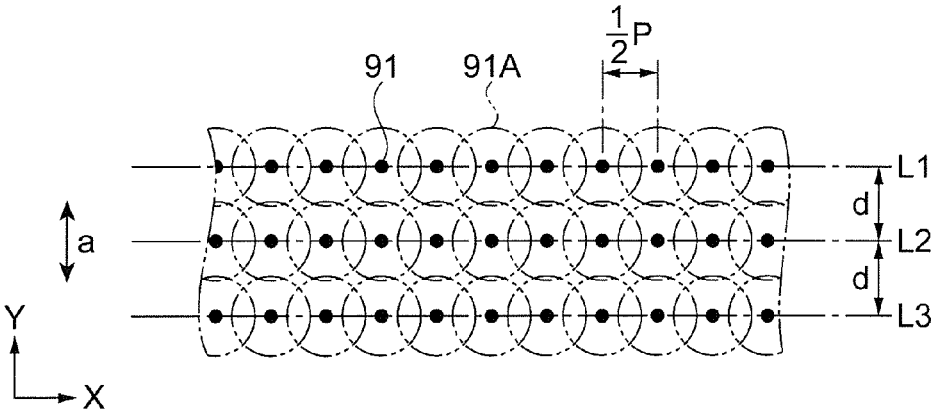
FIG. 5D is a descriptive diagram showing droplets having landed in a planar pattern.

Next, the relationship between array of the ejection nozzles 24 of the liquid droplet ejection heads 20, and the landing positions of droplets ejected from the respective ejection nozzles 24, is described with reference to FIG. 5. FIG. 5 is a descriptive diagram showing the relationship the ejection nozzles, and the landing positions of droplets ejected from the respective ejection nozzles. FIG. 5A is a descriptive diagram showing positions of disposition of ejection nozzles, FIG. 5B is a descriptive diagram showing droplets having landed in a linear pattern in the direction of extension of a nozzle row, FIG. 5C is a descriptive diagram showing droplets having landed in a linear pattern in the ejection scanning direction, and FIG. 5D is a descriptive diagram showing droplets having landed in a planar pattern. With the head unit 21 installed in the liquid droplet ejection device 1, the X-axis direction and Y-axis direction shown in FIG. 5 coincide with the X-axis direction and Y-axis direction shown in FIG. 1. The Y-axis direction is the ejection scanning direction; and as the ejection nozzles 24 (the liquid droplet ejection heads 20) undergo relative movement in the direction of the arrow as shown in FIG. 5 while ejecting droplets of the functional liquid at selected positions, the droplets can be made to land at selected positions in the Y-axis direction.

As shown in FIG. 5A, the ejection nozzles 24 constituting the nozzle rows 24A are arrayed at center-to-center spacing equal to a nozzle pitch P in the X-axis direction. As mentioned previously, the ejection nozzles 24 constituting two respective nozzle rows 24A are displaced in position with respect to one another in increments equal to ½ the nozzle pitch P, in the X-axis direction.

As shown in FIG. 5B, states of single landed droplets are shown by landing points 91 that show landing position, and landing circles 91A that show wetting and spreading out of the landed droplets. By ejecting the respective droplets from all of the ejection nozzles 24 of the two nozzle rows 24A at a timing such that they land on a hypothetical line L shown by a double-dot and dash line in FIG. 5B, a straight line of landing circles 91A lined up at center-to-center spacing equal to ½ the nozzle pitch P is formed.

As shown in FIG. 5C, a straight line of landing circles 91A lined up in the Y-axis direction is formed by successive ejection of droplets from a single ejection nozzle 24. The minimum value of center-to-center distance between landing circles 91 in the Y-axis direction is denoted as a minimum landing distance d. The minimum landing distance d is the product of the relative speed of movement in the ejection scanning direction (mm/sec), and the minimum ejection interval of the ejection nozzles 24 (sec).

As shown in FIG. 5D, by ejecting the respective droplets at a timing such that they land on hypothetical lines L1, L2, L3 shown by double-dot and dash lines, there is formed a landing plane of straight lines which are composed of landing circles 91A lining up at center-to-center spacing equal to ½ the nozzle pitch P, and which are juxtaposed in the Y-axis direction. In a case in which the distance between the hypothetical lines L1, L2, L3 shown in FIG. 5D is equal to the minimum landing distance d, the respective landing points 91 represent positions at which droplets of the functional liquid may be disposed by the liquid droplet ejection device 1.

During printing of an image, with regard to the positions of the respective landing points 91 shown in FIG. 5D, the positions at which to dispose the droplets are determined in accordance with information about the image. For example, there is created a disposition table specifying the disposition positions in question, as well as the ejection nozzles 24 to eject droplets onto those the disposition positions; and the image specified by the image information is printed by causing the functional liquid to land in accordance with the disposition table. In the example shown in FIG. 5D, gaps are present between the landing circles 91A; however, by defining an appropriate per-droplet ejection weight for the ejected droplets with respect to the nozzle pitch P and the minimum landing distance d, it is possible for the functional liquid to be disposed without any gaps.

Ultraviolet Irradiation Time

Figure 6A:
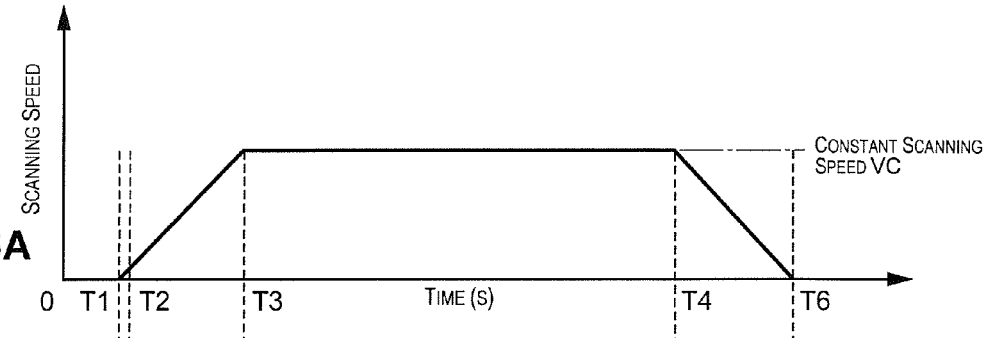
FIG. 6A is a descriptive diagram showing temporal change of the scanning speed of the carriage unit.
Figure 6B:
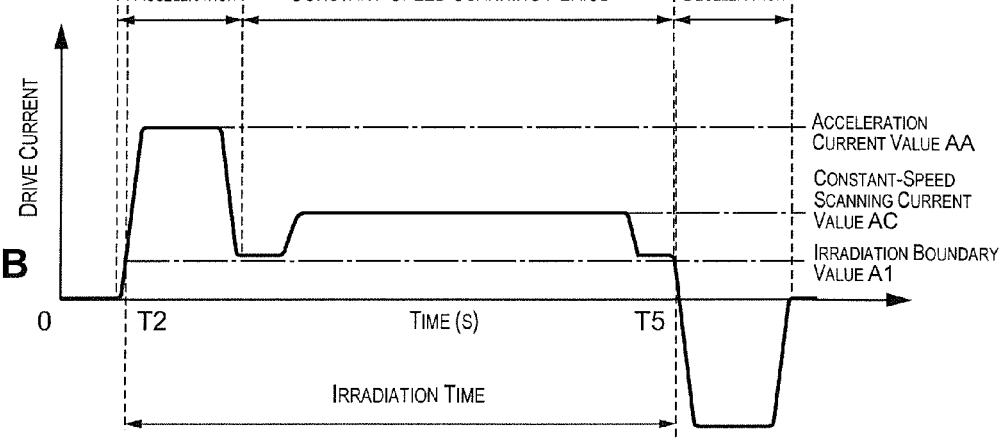
FIG. 6B is a descriptive diagram showing temporal change of drive current in association with temporal change of the scanning speed of the carriage unit, as well as showing UV LED ON times and OFF times.
Figure 7A:
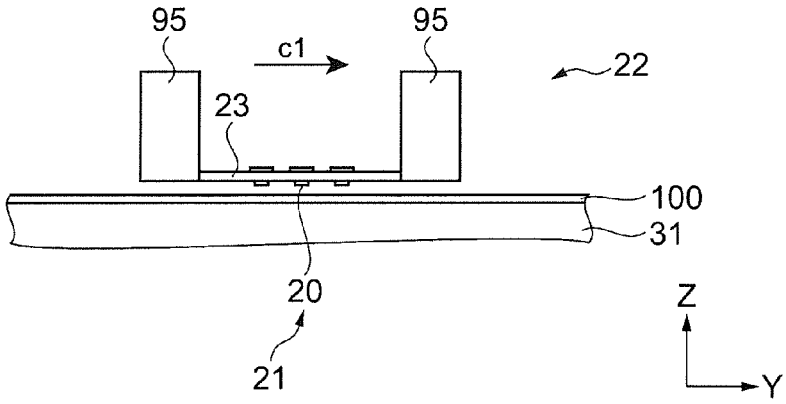
FIG. 7A is a descriptive diagram showing the shape of the side face of the carriage unit when viewed from a direction parallel to the X axis direction, and the positional relationship of the carriage unit and the printing medium.
Figure 7B:
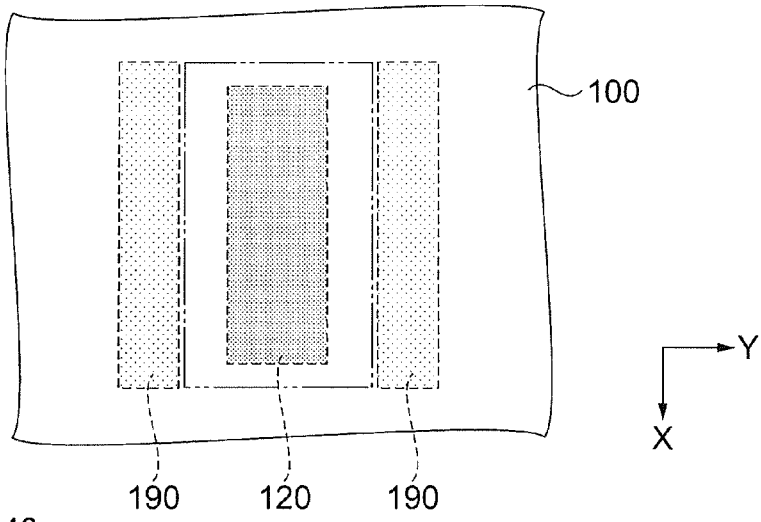
FIG. 7B is a descriptive diagram showing the positional relationship of a head-opposed area on the printing medium, and an irradiation section-opposed area.
Figure 7C:
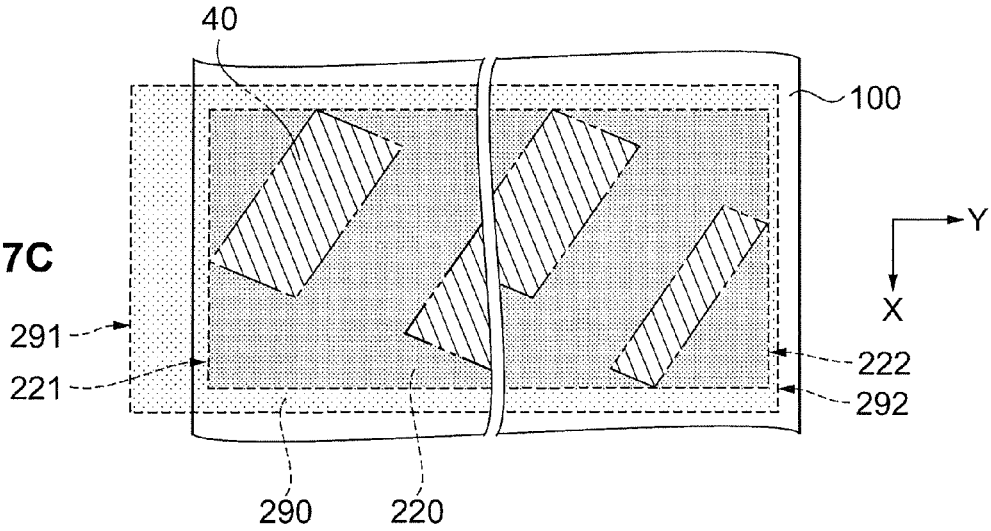
FIG. 7C is a descriptive diagram showing the positional relationship of the leading edge and the trailing edge of a target landing area in a single ejection scan, and the leading edge and the trailing edge of a UV irradiation area.

Next, the irradiation time during which the UV LEDs 96 are controlled to irradiate ultraviolet based on the drive current value of the drive motor 67, and the UV irradiation area which is irradiated with ultraviolet thereby, are described with reference to FIGS. 6 and 7. FIG. 6 is a descriptive diagram showing temporal change of the drive current in association with scanning speed of the carriage unit, as well as showing UV LED ON times and OFF times corresponding to the drive current. FIG. 6A is a descriptive diagram showing temporal change of the scanning speed of the carriage unit, and FIG. 6B is a descriptive diagram showing temporal change of the drive current in association with temporal change of the scanning speed of the carriage unit, as well as showing UV LED ON times and OFF times. FIG. 7 is a descriptive diagram showing the positional relationship of a head-opposed area (targeted landing area) and irradiation section-opposed areas (UV irradiation areas), contrasted with the carriage unit. FIG. 7A is a descriptive diagram showing the shape of the side face of the carriage unit when viewed from a direction parallel to the X-axis direction, and the positional relationship of the carriage unit and the printing medium, FIG. 7B is a descriptive diagram showing the positional relationship of the head-opposed area on the printing medium, and the irradiation section-opposed areas, and FIG. 7C is a descriptive diagram showing the positional relationship of the leading edge and the trailing edge of the target landing area in a single ejection scan, and the leading edge and the trailing edge of the UV irradiation area. With the carriage unit 22 installed in the liquid droplet ejection device 1, the X-axis direction, the Y-axis direction, and the Z-axis direction shown in FIG. 7 coincide with the -axis direction, the Y-axis direction, and the Z-axis direction shown in FIG. 1.

As shown in FIG. 6A, the drive motor 67 starts up at time T1, and the carriage unit 22 accelerates. The carriage unit 22 accelerates from time T1 to time T3, and enters a constant-speed scan state starting from time T3. The scanning speed at this time is denoted as constant scanning speed VC. The carriage unit 22 is scanned at constant speed from time T3 to time T4, decelerates starting from time T4, and halts at time T6.

As shown in FIG. 6B, as a consequence of changes of the scanning speed of the carriage unit 22, the drive current flowing to the drive motor 67 takes on different current values. The carriage unit 22 accelerates from time T1 to time T3, and due to the high load placed on the drive motor 67, a large current flows thereto. The maximum current value observed during acceleration of the carriage unit 22 is denoted as the acceleration current value AA. When the speed of the carriage unit 22 is equal to the constant scanning speed VC, due to the lower load lower than during acceleration, the drive current value is lower as well. The drive current value observed when the carriage unit 22 is being scanned at the constant scanning speed VC is denoted as the constant-speed scanning current value AC. During deceleration starting from time T4, the load is in the decreasing direction in order to halt the drive motor 67. In this case, because the voltage from the power supply is not applied to the drive motor 67, there is no flow of drive current. The current value observed in this case is denoted in FIG. 6B as electrical current in the opposite direction from the electrical current during acceleration. Due to instantaneous flow of the acceleration current value AA during acceleration, time T3 is followed by a time interval in which the current value is slightly lower than the constant-speed scanning current value AC. This time interval is shorter than that of instantaneous flow of the acceleration current value AA.

The current value serving as the criterion for switching the UV LEDs 96 to ON or OFF is denoted as the irradiation boundary value A1. A current value lower than the constant-speed scanning current value AC is set as the irradiation boundary value A1. The irradiation boundary value A1 shown in FIG. 6B has been established at a value slightly lower than the drive current value observed when the carriage unit 22 is being scanned at the constant scanning speed VC.

At time T2, the current value of the drive current during acceleration of the carriage unit 22 is equal to or greater than the irradiation boundary value A1. At time T2, the ultraviolet irradiation controller 74 switches the UV LEDs 96 to ON. At time T5, the current value of the drive current during deceleration of the carriage unit 22 is less than the irradiation boundary value A1. At time T5, the ultraviolet irradiation controller 74 switches the UV LEDs 96 to OFF. Consequently, the UV LEDs 96 go ON at the point in time that the current value of the drive current transitions from less than the irradiation boundary value A1 to equal to or greater than the irradiation boundary value A1, and go OFF at the point in time that the current value of the drive current transitions from equal to or greater than the irradiation boundary value A1 to less than the irradiation boundary value A1. Alternatively, the UV LEDs 96 may be placed in the ON state when the current value of the drive current is equal to or greater than the irradiation boundary value A1. The irradiation boundary value A1 corresponds to the first output value.

As shown in FIG. 7A, the head unit 21 provided to the carriage unit 22, and the two ultraviolet irradiation sections 95, are lined up in opposition to the printing medium 100.

As shown in FIG. 7B, an area of the printing medium 100, which area lies in opposition to the head unit 21, is denoted as the head-opposed area 120; and areas lying in opposition to the ultraviolet irradiation sections 95 are denoted as irradiation section-opposed areas 190.

The head-opposed area 120 is a rectangular area representing a zone of the printing medium 100 supported by the medium placement stage 31, which zone lies in opposition to the nine liquid droplet ejection heads 20 provided to the head unit 21. The functional liquid ejected from the unit nozzle row 240A is positioned having landed within a zone equal in width to the head-opposed area 120 in the X-axis direction. The irradiation section-opposed areas 190 are zones of the printing medium 100 supported by the medium placement stage 31, which zones are able to be simultaneously irradiated with ultraviolet by the ultraviolet irradiation sections 95.

As shown in FIG. 7C, an area of the trajectory of the scan of the head-opposed area 120 in the Y-axis direction as the carriage unit 22 is scanned is denoted as a target landing area 220. An area of the trajectory of a scan of the irradiation section-opposed areas 190 in the Y-axis direction is denoted as a UV-irradiation area 290. Of the ultraviolet irradiation sections 95 respectively arranged at either side of the head unit 21, the ultraviolet irradiation section 95 at the back side of the head unit 21 in relation to the direction of advance is the ultraviolet irradiation section 95 that operates during ejection scanning. In a case in which the scanning direction is the direction shown by the arrow c1 in FIG. 7A, the ultraviolet irradiation section 95 to the back side of the arrow c1 will be the one that operates.

The liquid droplet ejection heads 20 of the head unit 21 carry out ejection in the constant-speed scanning period from time T3 to time T4, causing droplets of the functional liquid to land in the target landing area 220 between a landing area leading edge 221 and a landing area trailing edge 222. An image 40 is formed in the target landing area 220 by the functional liquid landing therein.

The ultraviolet irradiation section 95 to the back side of the arrow c1 emits ultraviolet during the period from time T2 to time T5, and irradiates with ultraviolet the UV-irradiation area 290 between an irradiation area leading edge 291 and an irradiation area trailing edge 292. Because the irradiation boundary value A1 has been established at a value slightly lower than the drive current value in the case in which the carriage unit 22 is being scanned at the constant scanning speed VC, time T5 is later than time T4. For this reason, the irradiation area trailing edge 292 is positioned to the downstream side (front side) of the landing area trailing edge 222, in the scanning direction of the carriage unit 22. Therefore, the target landing area 220 is encompassed within the UV-irradiation area 290, and the functional liquid having landed in the target landing area 220 is irradiated with ultraviolet.

On the printing medium 100, any single point in opposition to the ultraviolet irradiation section 95 is irradiated with ultraviolet while positioned within the irradiation section-opposed area 190. The product of the irradiation time and the intensity of the ultraviolet emitted by the UV LEDs 96 is the irradiated dose, and it is necessary for the irradiation time in question to be enough for irradiation with a sufficient dose. For this reason, time T2 is a point in time at which the front edge of the irradiation section-opposed area 190 in the scanning direction coincides with the irradiation area leading edge 291. Time T5 is a point in time at which the back edge of the irradiation section-opposed area 190 in the scanning direction coincides with the irradiation area trailing edge 292.

The UV-irradiation area 290 is irradiated with ultraviolet in a dose sufficient to bring about curing of the functional liquid landed therein, at an appropriate curing rate. To the front and back of the UV-irradiation area 290 in the Y-axis direction (the ejection scanning direction). there exist areas which have been irradiated with ultraviolet at a dose less than the dose sufficient for the functional liquid landed therein to cure at an appropriate curing rate.

The functional liquid is made to land on any single point of the printing medium 100, by ejecting a droplet from any of the ejection nozzles 24 belonging to the head unit 21, doing so at a point in time when the ejection nozzle 24 in question is positioned at an appropriate ejection position. In the example discussed above, the ejection nozzles 24 belonging to the head unit 21 number 3,240. Within a zone of a single head-opposed area 120, the functional liquid can be made to land at 3,240 points on the printing medium 100, which correspond to the positions of the ejection nozzles 24 that were described with reference to FIG. 3.

In order to cause droplets of the functional liquid to land throughout the entirety of the target landing area 220, successive head-opposed areas 120 are spaced at intervals equal to the minimum landing distance d; and within the respective head-opposed areas 120, ejection is carried out from all of the nozzles 24 belonging to the head unit. 21. In a case in which ejection from the ejection nozzles 24 begins at time T3, time T3 is the point in time at which one-half of the minimum ejection interval (sec) of the ejection nozzles 24 has elapsed, since the point in time that the front edge of the head-opposed area 120 in the scanning direction coincided with the landing area leading edge 221. In a case in which ejection from the ejection nozzles 24 is halted at time T4, time T4 is the point in time at which the back edge of the head-opposed area 120 in the scanning direction coincides with the landing area trailing edge 222.

In the manner discussed above, of the ultraviolet irradiation sections 95 respectively arranged to either side of the head unit 21, the ultraviolet irradiation section 95 to the back side of the head unit 21 in the direction of advance is the one that is operated; however, it is also acceptable to operate both of the ultraviolet irradiation sections 95 respectively arranged to either side of the head unit 21. In a case of operation of both of the ultraviolet irradiation sections 95, the ON time and the OFF time may differ between the two ultraviolet irradiation sections 95 furnished to the carriage unit 22.

First Alternative Example of Ultraviolet Irradiation Time

Next, an example of ultraviolet irradiation time in which the area for irradiation with ultraviolet is a UV irradiation area 294 that is different from the UV irradiation area 290 discussed above is described with reference to FIG. 8. FIG. 8 is a descriptive diagram of temporal change of drive current, shown in association with scanning speed of the carriage unit, and showing UV LED ON times and OFF times in correspondence with the driving current; and a descriptive diagram showing the positional relationship of the leading edge and the trailing edge of a target landing area in a single ejection scan, and the leading edge and the trailing edge of a UV irradiation area. FIG. 8A is a descriptive diagram showing temporal change of the scanning speed of the carriage unit, FIG. 8B is a descriptive diagram showing temporal change of drive current in association with temporal change of the scanning speed of the carriage unit, as well as showing UV LED ON times and OFF times, and FIG. 8C is a descriptive diagram showing the positional relationship of the leading edge and the trailing edge of a target landing area in a single ejection scan, and the leading edge and the trailing edge of a UV irradiation area. With the carriage unit 22 installed in the liquid droplet ejection device 1, the X-axis direction and the Y-axis direction shown in FIG. 8C coincide with the X-axis direction and the Y-axis direction shown in FIG. 1.

The temporal change of the scanning speed of the carriage unit 22 shown in FIG. 8A, and the temporal change of the current value of the drive current of the drive motor 67 shown in FIG. 8B, are comparable to the temporal change of the scanning speed of the carriage unit 22 described with reference to FIG. 6A, and the temporal change of the current value of the drive current of the drive motor 67 described with reference to FIG. 6B.

As shown in FIG. 8B, the current value of the drive current during acceleration of the carriage unit 22 is equal to or greater than the irradiation boundary value A1 at time T2. The ultraviolet irradiation controller 74 turns the UV LEDs 96 ON at a time T21 following time T2 by an ON delay time t1. Time T21 is the point in time that the front edge of the irradiation section-opposed area 190 in the scanning direction has approximately coincided with the landing area leading edge 221. The point in time for the ultraviolet irradiation controller 74 to turn the UV LEDs 96 OFF is the time T5 mentioned previously.

As shown in FIG. 8C, by turning the UV LEDs 96 to ON at time T21, an irradiation area leading edge 295 of the UV irradiation area 294 approximately coincides with the landing area leading edge 221 of the target landing area 220. The ultraviolet irradiation section 95 emits ultraviolet for a period from time T21 to time T5, and irradiates with ultraviolet the UV irradiation area 294 from the irradiation area leading edge 295 to an irradiation area trailing edge 292. The ON delay time t1 corresponds to the predetermined delay time.

The ON delay time t1 is set, for example, according to the positions of the respective ultraviolet irradiation sections 95 of the carriage unit 22, and the scanning speed.

In the manner discussed above, of the ultraviolet irradiation sections 95 respectively arranged to either side of the head unit 21, the ultraviolet irradiation section 95 to the back side of the head unit 21 in the direction of advance is the one that is operated; however, it is also acceptable to operate both of the ultraviolet irradiation sections 95 respectively arranged to either side. In a case in which both of the ultraviolet irradiation sections 95 are operated, a different ON delay time t1 may be set for each of the two ultraviolet irradiation sections 95 furnished to the carriage unit 22.

In the respective ultraviolet irradiation sections 95, the UV LEDs 96 may be turned OFF at the point in time that the UV irradiation area 294 or other such UV irradiation area approximately coincides with the target landing area 220 of the printing medium 100.

Second Alternative Example of Ultraviolet Irradiation Time

Next, an example of ultraviolet irradiation time in which the area for irradiation with ultraviolet is a UV irradiation area 296 that is different from the UV irradiation area 290 and the UV irradiation area 294 discussed above is described with reference to FIG. 9. FIG. 9 is a descriptive diagram showing temporal change of drive current in association with scanning speed of the carriage unit, and showing UV LED ON times and OFF times in correspondence with the driving current; and a descriptive diagram showing the positional relationship of the leading edge and the trailing edge of a target landing area in a single ejection scan, and the leading edge and the trailing edge of a UV irradiation area. FIG. 9A is a descriptive diagram showing temporal change of the scanning speed of the carriage unit, FIG. 9B is a descriptive diagram showing temporal change of drive current in correspondence with temporal change of the scanning speed of the carriage unit, as well as showing UV LED ON times and OFF times, and FIG. 9C is a descriptive diagram showing the positional relationship of the leading edge and the trailing edge of a target landing area in a single ejection scan, and the leading edge and the trailing edge of a UV irradiation area. With the carriage unit 22 installed in the liquid droplet ejection device 1, the X-axis direction and the Y-axis direction shown in FIG. 9C coincide with the X-axis direction and the Y-axis direction shown in FIG. 1.

The temporal change of the scanning speed of the carriage unit 22 shown in FIG. 9A, and the temporal change of the current value of the drive current of the drive motor 67 shown in FIG. 9B, are comparable to the temporal change of the scanning speed of the carriage unit 22 described with reference to FIG. 6A, and the temporal change of the current value of the drive current of the drive motor 67 described with reference to FIG. 6B.

As shown in FIG. 9B, the current value of the drive current during acceleration of the carriage unit 22 is equal to or greater than the irradiation boundary value A1 at time T2. The ultraviolet irradiation controller 74 turns the UV LEDs 96 to ON at time T2. At a time T51 following the time T2 by a set irradiation time interval t2, the ultraviolet irradiation controller 74 turns the UV LEDs 96 to OFF. The time T51 is the point in time that the back edge of the irradiation section-opposed area 190 in the scanning direction has approximately coincided with the landing area trailing edge 222.

As shown in FIG. 9C, by turning the UV LEDs 96 to OFF at time T51, an irradiation area trailing edge 298 of the UV irradiation area 296 approximately coincides with the landing area trailing edge 222 of the target landing area 220. The ultraviolet irradiation section 95 emits ultraviolet for a period from time T2 to time T51, and irradiates with ultraviolet the UV irradiation area 298 from the irradiation area leading edge 291 to an irradiation area trailing edge 296.

In the manner discussed above, of the ultraviolet irradiation sections 95 respectively arranged to either side of the head unit 21, the ultraviolet irradiation section 95 to the back side of the head unit 21 in the direction of advance is the one that is operated; however, it is also acceptable to operate both of the ultraviolet irradiation sections 95 respectively arranged to either side. In a case in which both of the ultraviolet irradiation sections 95 are operated, a different set irradiation time interval t2 may be set for each of the two ultraviolet irradiation sections 95 furnished to the carriage unit 22. The respective ultraviolet irradiation sections 95 may be controlled in such a way that the back edges of the irradiation section-opposed areas 190 of the two ultraviolet irradiation sections 95 in the scanning direction respectively approximately coincide with the landing area trailing edge 222 at the point in time that the UV LEDs 96 are turned to OFF.

Third Alternative Example of Ultraviolet Irradiation Time

Figures 10A, 10B:
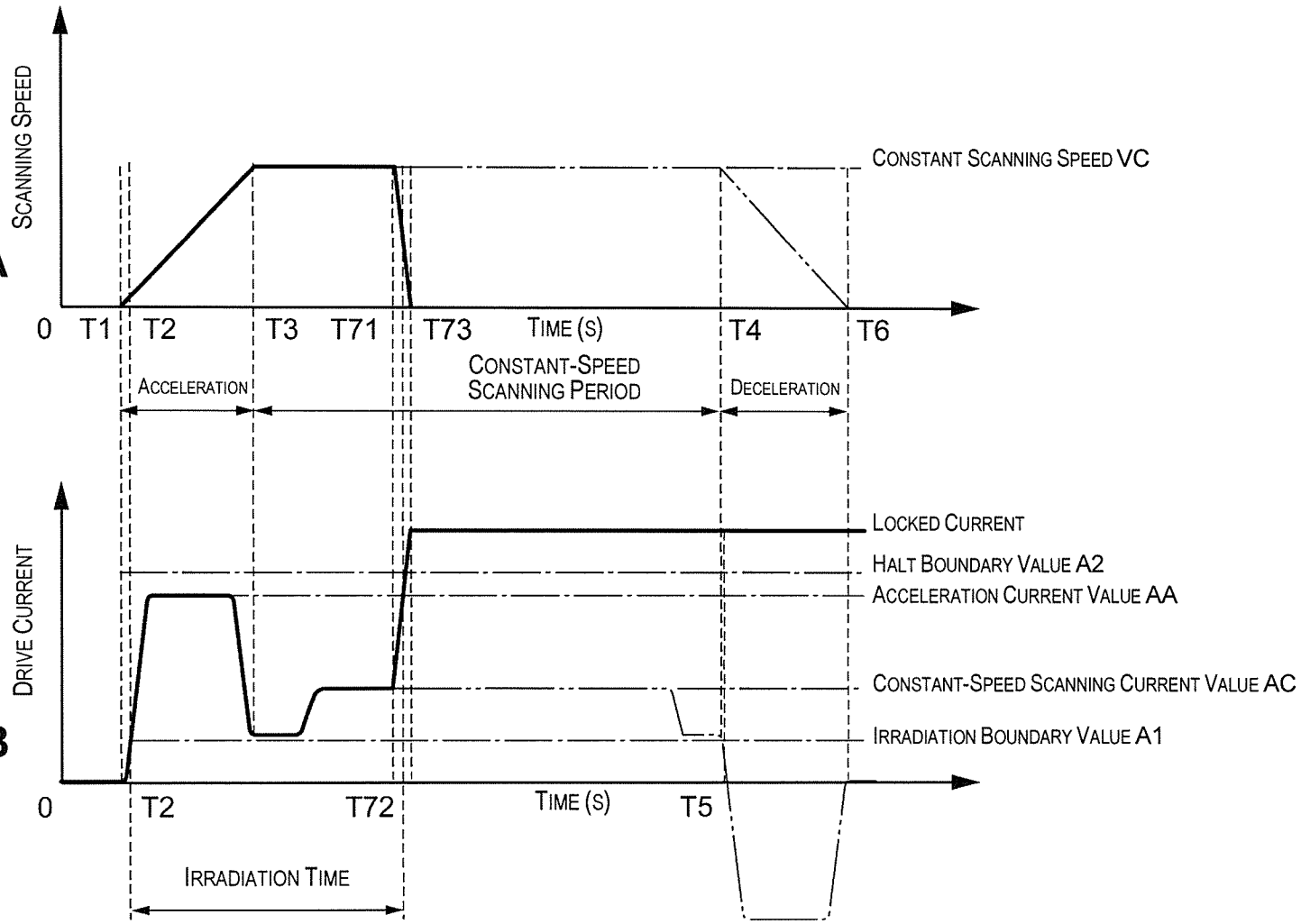
FIG. 10A is a descriptive diagram showing temporal change of the scanning speed of the carriage unit.
FIG. 10B is a descriptive diagram showing temporal change of drive current in association with temporal change of the scanning speed of the carriage unit, as well as showing UV LED ON times and OFF times.

Next, an example of ultraviolet irradiation when the carriage scanning mechanism 62 has encountered a problem is described with reference to FIG. 10. FIG. 10 is a descriptive diagram showing temporal change of drive current in association with scanning speed of the carriage unit, and showing UV LED ON times and OFF times in correspondence with the driving current. FIG. 10A is a descriptive diagram showing temporal change of the scanning speed of the carriage unit, and FIG. 10B is a descriptive diagram showing temporal change of drive current in correspondence with temporal change of the scanning speed of the carriage unit, as well as showing UV LED ON times and OFF times.

As discussed previously, for example, the drive motor 67 is started at time T1, and the carriage unit 22 accelerates. The carriage unit 22 accelerates from time T1 to time T3, and from time T3 enters the constant-speed scan state. Having entered the constant-speed scan state, the carriage unit 22 is scanned at the given constant scanning speed VC from time T3 to time T4, decelerates starting from time T4, and halts at time T6.

In the example shown in FIG. 10A, the carriage scanning mechanism 62 encounters a malfunction at time T71, halting the carriage scanning mechanism 62. The carriage unit 22 comes to a halt at time T73. A possible malfunction of the carriage scanning mechanism 62 is, for example, a case in which the drive pulley 67*a*, the driven pulley 67*b*, the belt 62*a*, etc., is forcibly brought to a stop by a foreign object, whereby the output shaft of the drive motor 67 is locked and brought to a halt.

As mentioned previously, the current value of the drive current flowing to the drive motor 67 differs according to change in the scanning speed of the carriage unit 22. From time T1 to time T3, the carriage unit 22 accelerates, and due to the large load placed on the drive motor 67, the acceleration current value AA flows. When the speed of the carriage unit 22 reaches the constant scanning speed VC, the load decreases from that during acceleration, and the constant-speed scanning current value AC flows.

As shown in FIG. 10B, because the output shaft of the drive motor 67 is locked and brought to a halt, the current value of the drive current flowing to the drive motor 67 rises from the constant-speed scanning current value AC to the locked current of the drive motor 67.

A reference current value for turning the UV LEDs 96 to OFF in the event of an emergency is denoted as a halt boundary value A2. The halt boundary value A2 may be set to a current value that is greater than the constant-speed scanning current value AC, but smaller than the current value of the locked current. The halt boundary value A2 shown in FIG. 6B has been set to a current value greater than the acceleration current value AA, and less than the current value of the locked current.

The current value of the drive current when the drive motor 67 is halted from time T71 to time T73 is equal to or greater than the halt boundary value A2, at time T72. At time T72, the ultraviolet irradiation controller 74 turns the UV LEDs 96 to OFF. The halt boundary value A2 corresponds to the second output value.

At any point in time subsequent to time T72 in FIG. 10, the drive motor 67 may be controlled to bring it to a halt (to cease to apply drive voltage).

The effects of the embodiment are set forth below. According to the present embodiment, the following effects are obtained.

(1) The liquid droplet ejection device 1 is provided with the ammeter 69, which measures the drive current of the drive motor 67 and transmits the results of measurement to the ultraviolet irradiation controller 74. According to the drive current value of the drive motor 67 measured by the ammeter 69, the ultraviolet irradiation controller 74 controls the UV LEDs 96 to emit ultraviolet. Because the drive current value of the drive motor 67 differs according to the load placed on the drive motor 67, the state of driving of the drive motor 67 can be discerned from the drive current value of the drive motor 67. By controlling the UV LEDs 96 to emit ultraviolet according to the drive current value of the drive motor 67, the UV LEDs 96 can be made to emit ultraviolet at appropriate occasions associated with the state of driving of the drive motor 67, and appropriate positions can be irradiated with ultraviolet.

(2) The ultraviolet irradiation controller 74 turns the UV LEDs 96 to ON at time T2 when the current value of the drive current of the drive motor 67 has reached the irradiation boundary value A1 or above. Also, the UV LEDs 96 are turned OFF at time T5, when the current value falls below the irradiation boundary value A1. In so doing, instances in which the UV LEDs 96 are placed in the ON state in cases in which it is unnecessary for them to be placed in the ON state can be minimized, as compared with the case in which the UV LEDs 96 are placed in the ON state for the entire time that the drive motor 67 is driven.

(3) The ultraviolet irradiation time for which the area irradiated with ultraviolet is the UV irradiation area 294 begins when the UV LEDs 96 turn ON at time T21 which follows time T2 by the ON delay time t1. Because time T21 is the point in time that the front edge of the irradiation section-opposed area 190 in the scanning direction has approximately coincided with the landing area leading edge 221, the irradiation area leading edge 295 of the UV irradiation area 294 can be made to approximately coincide with the landing area leading edge 221 of the target landing area 220. Specifically, instances in which areas not included in the target landing area 220 are irradiated with ultraviolet can be minimized.

(4) The ultraviolet irradiation time for which the area irradiated with ultraviolet is the UV irradiation area 296 begins when the UV LEDs 96 turn ON at time T2; and at a time T51 after the set irradiation time interval t2 following turning ON, the UV LEDs 96 are turned to OFF. The time T51 is the point in time that the back edge of the irradiation section-opposed area 190 in the scanning direction has approximately coincided with the landing area trailing edge 222. In so doing, the irradiation area trailing edge 298 of the UV irradiation area 296 can be made to approximately coincide with the landing area trailing edge 222 of the target landing area 220. Specifically, instances in which areas not included in the target landing area 220 are irradiated with ultraviolet can be minimized.

(5) The ultraviolet irradiation time for which the area irradiated with ultraviolet is the UV irradiation area 290 begins when the UV LEDs 96 turn ON at time T2, with time T2 being the point in time that the current value of the drive current of the drive motor 67 is equal to or greater than the irradiation boundary value A1. The irradiation boundary value A1 is set to a value that is slightly lower than the drive current value observed when the carriage unit 22 is being scanned at the constant scanning speed VC. In so doing, time T2 can be brought closer to time T3, as compared with the case in which there is a large difference between the irradiation boundary value A1 and the constant scanning speed VC.

While a preferred embodiment has been described hereinabove with reference to the accompanying drawings, the preferred embodiments are not limited to the aforedescribed embodiment. Various modifications of the embodiment, such as the following, are possible within the scope thereof.

First Modification Example

In the aforedescribed embodiment, the ultraviolet irradiation time for which the area irradiated with ultraviolet is the UV irradiation area 294 begins when the UV LEDs 96 turn ON at time T21 which follows time T2 by the ON delay time t1. The ultraviolet irradiation time for which the area irradiated with ultraviolet is the UV irradiation area 296 begins when the UV LEDs 96 turn ON at time T2; and at a time T51 after the set irradiation time interval t2 following turning ON, the UV LEDs 96 are turned to OFF. However, the ultraviolet irradiation time may be an ultraviolet irradiation time having as the ON time thereof a point in time following elapse of an ON delay time subsequent to a reference time, and having as the OFF time a point in time following elapse of a predetermined time subsequent to the ON time. Alternatively, the ultraviolet irradiation time may be an ultraviolet irradiation time having as the ON time thereof a point in time following elapse of an ON delay time subsequent to a reference time, and having as the OFF time a point in time following elapse of a predetermined time subsequent to the reference time. In this case, the irradiation time would be (set irradiation time t2−ON delay time t1).

Second Modification Example

In the aforedescribed embodiment, the ultraviolet irradiation time for which the area irradiated with ultraviolet is the UV irradiation area 294 starts by turning the UV LEDs 96 to ON at time T21 which follows time T2 by the ON delay time t1. The time T2 is the point in time that the current value of the drive current of the drive motor 67 is equal to or greater than the irradiation boundary value A1, and the irradiation boundary value A1 is set to a value that is slightly lower than the drive current value observed when the carriage unit 22 is being scanned at the constant scanning speed VC. However, the starting point of the ON delay time may be, for example, the point in time of startup of the drive motor 67. Specifically, the first output value may be set to the smallest possible value within the range detectable by the drive output detecting part.

Third Modification Example

In the aforedescribed embodiment, the ultraviolet irradiation time for which the area irradiated with ultraviolet is the UV irradiation area 296 starts by turning the UV LEDs 96 to ON at time T2; and at a time T51 after the set irradiation time interval t2 following turning ON, the UV LEDs 96 are turned to OFF. The time T2 is the point in time that the current value of the drive current of the drive motor 67 is equal to or greater than the irradiation boundary value A1, and the irradiation boundary value A1 is set to a value that is slightly lower than the drive current value observed when the carriage unit 22 is being scanned at the constant scanning speed VC. However, the starting point of the predetermined time until the curing-light-emitting part turns OFF may be, for example, the point in time of startup of the drive motor 67. Specifically, the first output value may be set to the smallest possible value within the range detectable by the drive output detecting part.

Fourth Modification Example

In the aforedescribed embodiment, no particular specific examples of the printing medium 100 were shown; however, as the printing medium, there may be cited products on which an image is formed through formation of a film, and products requiring formation of a functional film such as a filter membrane.

Fifth Modification Example

In the aforedescribed embodiment, during ejection scanning, relative movement of the liquid droplet ejection head 20, the UV LEDs 96, and the printing medium 100 is brought about by scanning of the carriage unit 22 in the Y-axis direction by the carriage scanning mechanism 62. However, it is not essential for the relative scanning part that brings about relative movement of the ejection head, the curing-light-emitting part, and the printing medium to be means that scans the ejection head and the curing-light-emitting part. The relative scanning part may be means that scans the medium retaining part which retains the printing medium.

Sixth Modification Example

In the aforedescribed embodiment, the output of the drive source is the current value of the drive current of the drive motor 67, and the drive output detecting part is the ammeter 69. However, the output of the drive source may be another physical quantity. For example, it may be the rotation speed of the drive motor 67.

In a case in which the output of the drive source is the rotation speed of the drive motor, the first output value would be set to a rotation speed that is a positive number less than the rotation speed in a case in which the relative scanning part brings about relative movement of the head retaining part and the medium retaining part at a constant speed. The second output value would be set to a value greater than the rotation speed in a case in which the relative scanning part brings about relative movement of the head retaining part and the medium retaining part at a constant speed, but less than the rotation speed in a case in which the drive motor is in the unloaded state.

Cases in which it is conceivable that relative movement would be brought to a halt include a case in which the relative scanning part has become locked, or a case in which the transmission path for rotation of the drive motor is impaired, so that the rotation speed of the drive motor idles. In a case in which the relative scanning part has become locked, the curing-light-emitting part can be halted by detecting that the rotation speed of the drive motor is less than the first output value. In a case in which the transmission path for rotation of the drive motor is impaired, the curing-light-emitting part can be halted by detecting that the rotation speed of the drive motor exceeds the second output value.

Seventh Modification Example

In the aforedescribed embodiment, the liquid droplet ejection device 1 is provided with the head unit 21, and the functional liquid ejected from the liquid droplet ejection heads 20 provided to the head unit 21 is a single functional liquid. However, it is not essential for the same liquid to be ejected from the ejection heads provided to the head unit. In the printer, several different types of liquid, such as ones of different colors, may be ejected. Color printing by ejection of several different types of liquid of different colors is possible as well. The liquid droplet ejection device may be provided with a plurality of head unit, with the several types of liquid being ejected by different head units, by different sets of heads, by different liquid droplet ejection heads, or by different nozzle rows. Liquid droplet ejection heads capable of supplying liquids individually to each of the ejection nozzles may be employed to eject different liquids from each of the ejection nozzles. During color printing, finer printing would be possible by employing liquid droplet ejection heads or head units configured to be able to cause a plurality of liquids, for example, those of different colors, to land at the same given landing position; or by employing a scanning method.

Eighth Modification Example

In the aforedescribed embodiment, the liquid droplet ejection device 1 is provided with a single head unit 21. However, it is not essential that the printer be provided with a single head unit only. The printer may be provided with any number of head units.

Ninth Modification Example

In the aforedescribed embodiment, the head unit 21 is provided with nine liquid droplet ejection heads 20, but it is not essential that the head unit be provided with nine liquid droplet ejection heads. The head unit may be provided with any number of liquid droplet ejection heads.

Tenth Modification Example

In the aforedescribed embodiment, the liquid droplet ejection heads 20 are provided with two nozzle rows 24A of a multitude of ejection nozzles 24 lined up in approximately straight lines, but the liquid droplet ejection heads may be provided with any number of nozzle rows. Additionally, whereas the ejection nozzles 24 provided to the liquid droplet ejection heads 20 are displaced in position to one another in the direction of extension of the nozzle rows 24A, a scheme in which the ejection heads are provided with a plurality of ejection nozzles positioned at approximately identical positions in the direction of extension of the nozzle rows is also acceptable.

Eleventh Modification Example

In the aforedescribed embodiment, the UV LEDs 96 are LEDs that emit ultraviolet. However, it is not essential that the curing-light-emitting part be an LED. The curing-light-emitting part may be a lamp such as a metal halide lamp or the like.

Twelfth Modification Example

In the aforedescribed embodiment, the functional liquid ejected by the liquid droplet ejection heads 20 is an ultraviolet-curing functional liquid, and the ultraviolet irradiation sections 95 are provided with the UV LEDs 96 for emitting ultraviolet. However, it is not essential that the functional liquid employed in the liquid droplet ejection device described in the preceding embodiment be an ultraviolet-curing functional liquid. Liquids that cure through treatment with other curing light, such as thermal-curing liquids and the like, are also acceptable.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. An inkjet printer comprising:

a medium retaining part configured and arranged to retain a printing medium on which a photocuring liquid is disposed and printing is performed;

an ejection head configured and arranged to eject the liquid towards the printing medium retained by the medium retaining part;

a curing-light-emitting part configured and arranged to emit curing light at the printing medium retained by the medium retaining part to facilitate curing of the liquid;

a head retaining part configured and arranged to retain the ejection head and the curing-light-emitting part;

a relative scanning part configured and arranged to perform relative movement of the printing medium and the ejection head, and to perform relative movement of the head retaining part and the medium retaining part in an ejection scanning direction which is a direction of relative movement of the ejection head and the printing medium during ejection scanning in which the liquid is ejected from the ejection head and made to land on the printing medium;

a drive output detecting part configured and arranged to detect an output of a drive source of the relative scanning part; and a curing-light-emission-control part configured to control the curing-light-emitting part to emit the curing light, the curing-light-emission-control part being configured to place the curing-light-emitting part in an emission-enabled state in which the curing light is emitted or in an emission-disabled state in which the curing light is not emitted based on a detection result from the drive output detecting part, wherein the curing-light-emission-control part is configured to place the curing-light-emitting part in the emission-enabled state when the output of the drive source is equal to or greater than a first output value.

2. The inkjet printer according to claim 1, wherein the curing-light-emission-control part is configured to switch the curing-light-emitting part from the emission-disabled state to the emission-enabled state when the output of the drive source has transitioned from less than a first output value to equal to or greater than the first output value, and the curing-light-emission-control part is configured to switch the curing-light-emitting part from the emission-enabled state to the emission-disabled state when the output of the drive source has transitioned from equal to or greater than the first output value to less than the first output value.

3. The inkjet printer according to claim 1, wherein when the output of the drive source has transitioned from less than a first output value to equal to or greater than the first output value, the curing-light-emission-control part is configured to switch the curing-light-emitting part from the emission-disabled state to the emission-enabled state subsequent to a predetermined delay time after a transition timing of the output of the drive source from less than the first output value to equal to or greater than the first output value.

4. The inkjet printer according to claim 1, wherein the curing-light-emission-control part is configured to switch the curing-light-emitting part from the emission-enabled state to the emission-disabled state at a timing at which a predetermined time interval has elapsed since the curing-light-emitting part was placed in the emission-enabled state.

5. The inkjet printer according to claim 1, wherein the curing-light-emission-control part is configured to switch the curing-light-emitting part from the emission-enabled state to the emission-disabled state when the output of the drive source is equal to or greater than a second output value.

6. The inkjet printer according to claim 1, wherein the drive source of the relative scanning part is an electric motor, the drive output detecting part is an electrical current measurement device, and the output of the drive source is a current value of a drive power supplied to the electric motor.

7. The inkjet printer according to claim 6, wherein the first output value is a current value that is a product of a predetermined positive value smaller than 1 multiplied by the current value of the drive power supplied to the electric motor when a speed of the relative movement of the head retaining part and the printing medium during the ejection scanning is a predetermined constant speed.

8. The inkjet printer according to claim 6, wherein the drive source of the relative scanning part is an electric motor, the drive output detecting part is an electrical current measurement device, the output of the drive source is the current value of the drive power supplied to the electric motor, and the second output value is a current value that is less than a locked current when the electric motor is in a locked state, and greater than the current value of the drive power supplied to the electric motor when a speed of the relative movement of the head retaining part and the printing medium during the ejection scanning is a predetermined constant speed.

9. A method for controlling an inkjet printer including a medium retaining part for retaining a printing medium on which a photocuring liquid is disposed and printing is performed, an ejection head for ejecting the liquid towards the printing medium retained by the medium retaining part, a curing-light-emitting part for emitting curing light at the printing medium retained by the medium retaining part to facilitate curing of the liquid, a head retaining part for retaining the ejection head and the curing-light-emitting part, and a relative scanning part for performing relative movement of the printing medium and the ejection head and performing relative movement of the head retaining part and the medium retaining part in an ejection scanning direction which is a direction of relative movement of the ejection head and the printing medium during ejection scanning in which the liquid is ejected from the ejection head and made to land on the printing medium, the method comprising:

detecting an output of a drive source of the relative scanning part; and controlling the curing-light-emitting part to place the curing-light-emitting part in an emission-enabled state in which the curing light is emitted or in an emission-disabled state in which the curing light is not emitted based on a detection result in the detecting of the output of the drive source, wherein the controlling of the curing-light-emitting part includes placing the curing-light-emitting part in the emission-enabled state when the output of the drive source is equal to or greater than a first output value.

* * * * *